US006219019B1

(12) United States Patent
Hasegawa et al.

(10) Patent No.: US 6,219,019 B1
(45) Date of Patent: Apr. 17, 2001

(54) LIQUID CRYSTAL DISPLAY APPARATUS AND METHOD FOR DRIVING THE SAME

(75) Inventors: Rei Hasegawa; Tatsuo Saishu; Akira Kinno; Kohki Takatoh; Hiroyuki Nagata; Rieko Iida, all of Yokohama; Haruhiko Okumura, Fujisawa; Hisao Fujiwara, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 08/923,585

(22) Filed: Sep. 4, 1997

(30) Foreign Application Priority Data

Sep. 5, 1996 (JP) ..... 8-235571

(51) Int. Cl.[7] ..... G09G 3/36

(52) U.S. Cl. ..... 345/96; 315/169.4

(58) Field of Search ..... 345/96, 94, 95, 345/208, 209, 210; 315/169.4, 169.2

(56) References Cited

U.S. PATENT DOCUMENTS

| | | | | |
|---|---|---|---|---|
| 4,915,477 | * | 4/1990 | Ohta et al. | 350/333 |
| 5,379,138 | * | 1/1995 | Okada | 359/56 |
| 5,471,229 | * | 11/1995 | Okada et al. | 345/89 |
| 5,592,190 | * | 1/1997 | OKada et al. | 345/89 |
| 5,598,229 | * | 1/1997 | Okada et al. | 348/792 |
| 5,815,132 | * | 9/1998 | Okada et al. | 345/95 |
| 5,844,536 | * | 12/1998 | Okada et al. | 345/94 |
| 5,936,686 | | 8/1999 | Okumura et al. | 349/38 |
| 5,936,689 | * | 8/1999 | Saishu et al. | 349/123 |
| 5,949,391 | * | 9/1999 | Saishu et al. | 345/50 |

FOREIGN PATENT DOCUMENTS 8-292419 11/1996 (JP) .

OTHER PUBLICATIONS

Clark et al., "Submicrosecond Bistable Electro–optic Switching in Liquid Crystals," *Appl. Phys. Lett.*, 36(11), pp. 899–901 (1980).

Hartmann, "Ferroelectric Liquid Crystal Displays for Television Application," *Ferroelectrics*, vol. 122, pp. 1–26 (1991).

Chandani et al., "Tristable Switching in Surface Stabilized Ferroelectric Liquid Crystals with a Large Spontaneous Polarization," *Japanese Journal of Applied Physics*, vol. 27, No. 5, pp. L729–732 (1988).

Yamamoto et al., "Full–color Antiferroelectric Liquid Crystal Display," *Ferroelectrics*, vol. 149, pp. 295–304 (1993).

Fünfschilling et al., "Fast Responding and Highly Multiplexible Distorted Helix Ferroelectric Liquid–crystal Displays," *J. Appl. Phys.*, 66(8), pp. 3877–3882 (1989).

Patel, J. S., "Ferroelectric Liquid Crystal Modulator Using Twisted Smectic Structure," *Appl. Phys. Lett.*, 60, 3, pp. 280–282 (1992).

* cited by examiner

*Primary Examiner*—Vijay Shankar
*Assistant Examiner*—Vanel Frenel
(74) *Attorney, Agent, or Firm*—Finnegan, Henderson, Farabow, Garrett & Dunner, L.L.P.

(57) ABSTRACT

In a method for driving a liquid crystal display apparatus which includes liquid crystal having spontaneous polarization disposed between a plurality of pixel electrodes arranged in a matrix form and a common electrode disposed to face the pixel electrodes, the method for driving the liquid crystal display apparatus includes a polarity inversion of periodically inverting polarities of at least one part of voltages applied between the plurality of pixel electrodes and the common electrode, and a write-in operation of applying the voltages to the pixel electrodes to hold display voltages, respectively, corresponding to the applied voltages on the pixel electrode, wherein the polarity inversion is effected to satisfy the expression of TS/TF≧2 when a frame period is set to TF and a period for effecting the polarity inversion is set to TS.

22 Claims, 14 Drawing Sheets

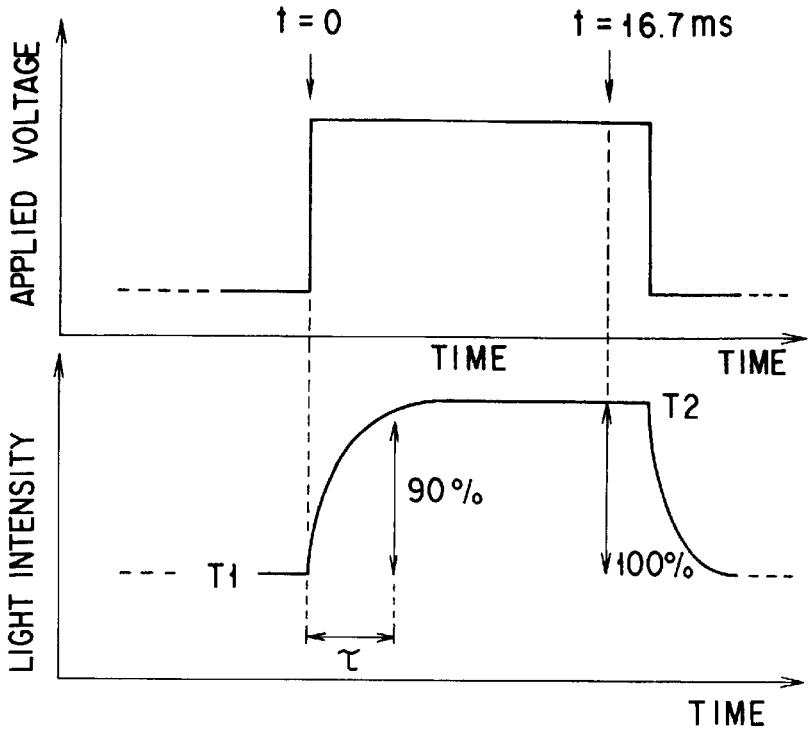
FIG. 3A
FIG. 3B
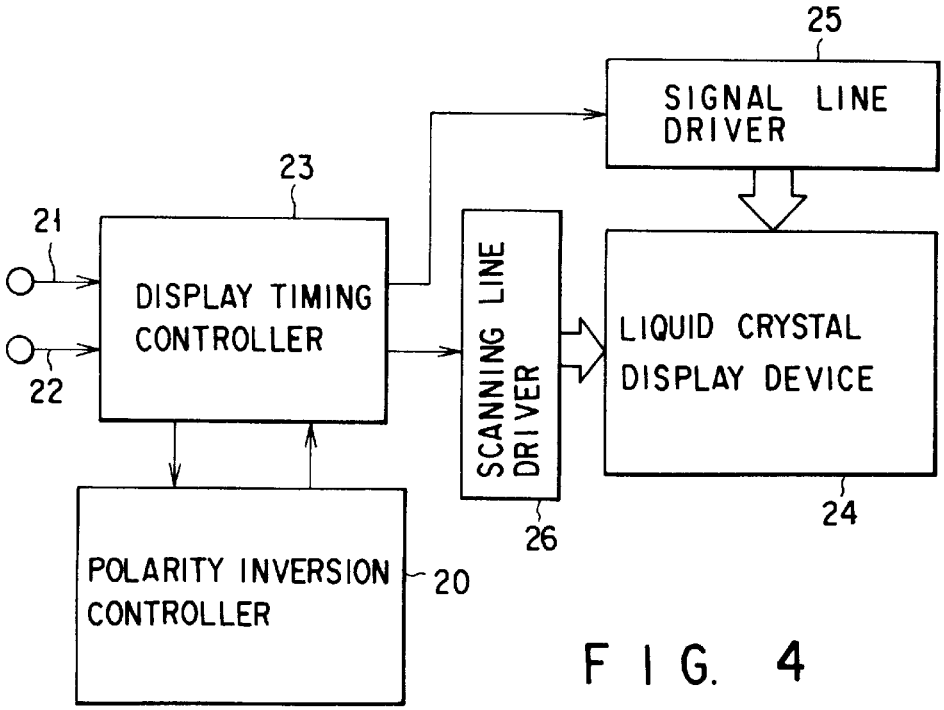
FIG. 4

F1
F2
F3
F4

31

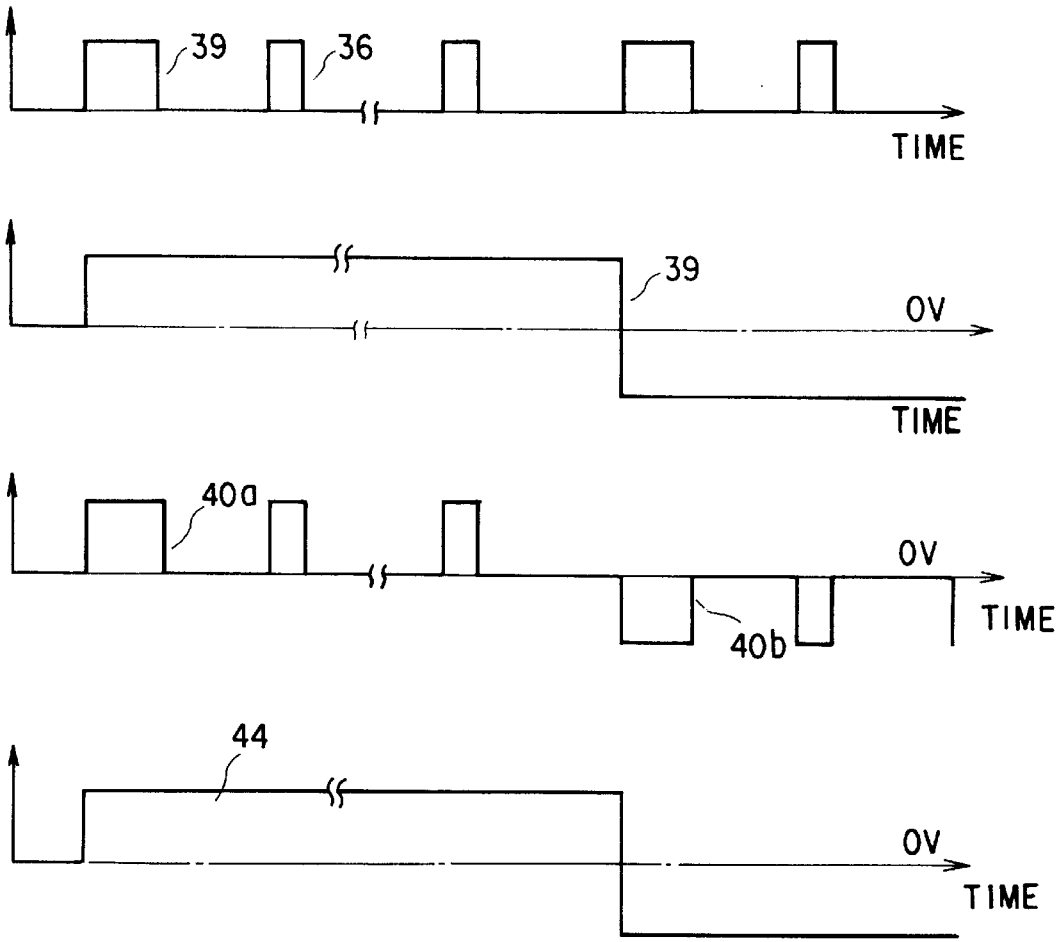
FIG. 8A GATE VOLTAGE
FIG. 8B SIGNAL VOLTAGE
FIG. 8C WRITE-IN VOLTAGE
FIG. 8D HOLDING VOLTAGE

LIQUID CRYSTAL DISPLAY APPARATUS AND METHOD FOR DRIVING THE SAME

BACKGROUND OF THE INVENTION

This invention relates to a liquid crystal display apparatus and a method for driving the same, and more particularly to an active matrix type liquid crystal display apparatus using a liquid crystal material having spontaneous polarization induced by application of an electric field or inherent spontaneous polarization and a method for driving the same.

A liquid crystal display apparatus has features of low power consumption and light weight and is widely used as a display device for a word processor, personal computer, car navigation system, and the like. As the above liquid crystal display apparatus, a TFT-TN system using nematic liquid crystal and using active elements such as thin film transistors (TFTs) as switching elements and an STN system using nematic liquid crystal and having an increased twist angle are known at present, and full-color display type liquid crystal display apparatuses of the above systems with the screen size of approximately 10 inches are already realized and are used as information terminal display devices.

The above liquid crystal display apparatuses have satisfactory characteristics for the limited application such as word processing and calculations on table. However, the STN system is still insufficient in the response speed in the above applications. Further, the viewing angle is extremely small and various studies are now made to enlarge the viewing angle by use of a retardation film, but a sufficiently large viewing angle is not yet attained.

On the other hand, the TN type liquid crystal display apparatus using TFTs as switching elements is substantially satisfied in the response speed, but it is estimated that some difficulty relating to the response speed will occur when a still larger liquid crystal display apparatus is manufactured. In addition, in the TN system, the viewing angle which is larger than that in the STN system can be attained, but the viewing angle becomes extremely small particularly in the case of full-color display and it is considered that the above problem limits the application of the above display system.

As a display system for solving the above problem of the liquid crystal display apparatus, recently, much attention is given to display systems using liquid crystal materials having spontaneous polarization induced by application of an electric field or inherent spontaneous polarization such as ferroelectric liquid crystal FLC, antiferroelectric liquid crystal AFLC, distorted helical ferroelectric liquid crystal DHF, twisted ferroelectric liquid crystal TFLC, or thresholdless antiferroelectric liquid crystal TLAF.

As the display system using the above liquid crystal material, a system using surface stabilized ferroelectric liquid crystal (SSFLC, N. A. Clark and S. T. Lagerewall Appl. Phys. Lett., 36,899 (1980)) is known. According to this system, the response speed is enhanced by two to three figures and the viewing angle is increased to a value equivalent to that of the cathode ray tube.

In the above display system, the switching operation is effected by relieving the helical structure of chiral smectic C phase of smectic liquid crystal by use of the interaction between an alignment film and the liquid crystal and using the torque generated by the interaction between the electric field and the spontaneous polarization caused at this time. In this system, since only two states in which the spontaneous polarization is set in two directions perpendicular to the interface of the alignment film are stabilized, it has a memory performance. Therefore, the system was first greatly expected as a display system in which switching elements constructed by non-linear active elements such as TFTs, TFDs (thin film diodes) or MIMs (metal-insulator-metal diodes) were not required.

However, in the above system, since only the two states are used, a gray scale cannot be displayed. When taking displays used in the future into consideration, display of the gray scale is indispensable and some studies for providing the display of gray scale have been made.

As an example of the above studies, some attempts for displaying the gray scale by using the surface stabilized ferroelectric liquid crystal described above have been made (for example, W. J. A. M. Harmann, Ferroelectrics, 1991, 122, p1). However, the surface stabilized ferroelectric liquid crystal displays a discontinuous switching characteristic called domain inversion in its response and it is substantially impossible to display the gray scale without using active elements.

On the other hand, a display system (A. D. L. Chandani, T. Hagiwara, T. Suzuki, Y. Ouchi, H. Takezoe and A. Fukuda, Jpn. J. Appl. Phys., 271,729 (1988)) using antiferroelectric liquid crystal and utilizing the antiferroelectric liquid crystal phase (SmCa phase) thereof is known. In this system, an antiferroelectric liquid crystal structure is provided at the time of no application voltage in addition to the two stabilized states of the ferroelectric liquid crystal, and recently, it is published that the gray scale display can be attained by use of the above display system without using switching elements constructed by active elements (N. Koshoubu, K. Mori, K. Nakamura, Y. Yamada, Ferroelectrics, 1993, 149, p295).

In addition to the above display systems, recently, display apparatuses using switching elements constructed by active elements and utilizing the chiral smectic C phase thereof are proposed. More specifically, a system using DHF (J. Funfschilling and M. Schadt, J. Appl. Phys. 66(8), 15), a system using TFLC (J. S. Pate, Appl. Phys. Lett. 60(3), p280) and TLAF (Thresholdless Antiferroelectric Liquid Crystal) have been proposed. Since a display apparatus using one of the above systems uses switching elements constructed by active elements, the cost thereof tends to become higher than that of the former systems.

The above systems are superior to the former systems in the following points. First, the reliability of gray scale display is excellent. That is, in the above systems, a variation in the transmittance with respect to an application voltage is relatively smooth and a problem that the gray scale display becomes difficult as in the surface stabilized ferroelectric liquid crystal will not occur. Secondly, the liquid crystal material used in the above systems can be driven on a low voltage (0 to 5V) and a liquid crystal display apparatus of low power consumption can be attained. Thirdly, display apparatuses of the above systems are highly resistant to the mechanical shock and will not cause destruction of alignment by the mechanical shock which may occur in the surface stabilized ferroelectric liquid crystal.

However, in a case where the active matrix driving operation of liquid crystal having spontaneous polarization is effected, the light transmittance in the ON state is significantly lowered in comparison with the case of static driving operation. As a result, the contrast is lowered and the display quality is degraded.

BRIEF SUMMARY OF THE INVENTION

An object of this invention is to provide a liquid crystal display apparatus which includes liquid crystal having spontaneous polarization induced by application of an electric field or inherent spontaneous polarization and disposed between pixel electrodes arranged in a matrix form and a common electrode disposed to face the pixel electrodes and capable of providing display of high image quality with high contrast and a method for driving the same.

In order to attain the above object, a method for driving a liquid crystal display apparatus according to a first aspect of this invention is provided as a method for driving a liquid crystal display apparatus which includes liquid crystal having spontaneous polarization disposed between a plurality of pixel electrodes arranged in a matrix form and a common electrode disposed to face the pixel electrodes and comprises a polarity inversion step of periodically inverting polarities of at least one part of voltages applied between the plurality of pixel electrodes and the common electrode; and a write-in step of applying the voltages to the pixel electrodes to hold display voltages corresponding to the applied voltages to the pixel electrodes, respectively, wherein the polarity inversion step is effected to satisfy an expression of $TS/TF \geqq 2$ when a frame period is set to TF and a period for effecting the polarity inversion is set to TS.

It is preferable to effect the polarity inversion to satisfy an expression of $TS/TF \geqq \tau/TK \geqq 2$ when a response time of the liquid crystal is set to $\tau$ and a write-in time is set to TK.

It is preferable that the write-in step includes a step of setting the write-in time for the pixel electrodes subjected to the polarity inversion among the plurality of pixel electrodes longer than the write-in time for the pixel electrodes other than the pixel electrodes subjected to the polarity inversion.

It is preferable that the write-in step includes a step of setting the write-in voltage for each of the pixel electrodes subjected to the polarity inversion among the plurality of pixel electrodes higher than the write-in voltage for each of the pixel electrode other than the pixel electrodes subjected to the polarity inversion.

The polarity inversion step may include a step of inverting the polarities of the voltages applied to the at least one part of the pixel electrodes in an image plane and may include a plurality of sub-steps of completing the polarity inversion for an entire portion of the image plane while sequentially changing the at least one part of the pixel electrodes to be subjected to the polarity inversion.

The polarity inversion step may include a step of effecting the polarity inversion in an image plane for at least one of the plurality of pixel electrodes.

The polarity inversion step may include a step of effecting the polarity inversion in an image plane for all of the pixel electrodes which lie on at least one scanning line among the plurality of pixel electrodes.

It is preferable that the polarity inversion step includes a step of effecting the polarity inversion in a state in which a ratio of the pixel electrodes to which a positive voltage is applied to the pixel electrodes to which a negative voltage is applied is set within a range of 0.5 to 2 in a desired area of 3 mm×3 mm in an image plane.

The step of effecting the polarity inversion to satisfy the expression of $TS/TF \geqq 2$ may be effected in a partial region of an image plane while a polarity inversion for each frame may be effected in a region other than the partial region.

The step of effecting the polarity inversion to satisfy the expression of $TS/TF \geqq 2$ may be intermittently effected for periods of time with an elapse of time while a polarity inversion for each frame may be effected in other periods of time.

The liquid crystal display apparatus may further include alignment films each formed on the pixel electrodes and the common electrode, a surface portion of the alignment film being made electrically conductive.

A liquid crystal display apparatus according to a second aspect of this invention comprises a first substrate; a plurality of pixel electrodes arranged in a matrix form on the first substrate; a second substrate disposed to face a surface of the first substrate on which the plurality of pixel electrodes are formed; a common electrode formed on the second substrate to face the plurality of pixel electrodes; and liquid crystal having spontaneous polarization and held between the first and the second substrate; wherein the liquid crystal display apparatus has an operation of periodical polarity inversion for at least one part of voltages applied between the plurality of pixel electrodes and the common electrode, and a write-in operation for applying the voltages to the pixel electrodes to hold display voltages corresponding to the applied voltages to the pixel electrode, respectively, and the polarity inverting operation is effected to satisfy an expression of $TS/TF \geqq 2$ when a frame period is set to TF and a period for effecting the polarity inversion is set to TS.

The liquid crystal display apparatus of this invention may have all of the operations described in the driving method of the first aspect.

The response time of the liquid crystal is the time required for a variation in light intensity to be made by 90% when the state is changed from the no voltage application state to the voltage application state or from the voltage application state to the no voltage application state.

A concrete example of a method for measuring the response time $\tau$ of the liquid crystal is explained below. If a back light is attached to a liquid crystal display device used for measurement, it is lit. If no back light is attached, the display device is placed on an adequate light source. For simplifying the measurement, it is possible to form a small simplified liquid crystal cell having no TFT or the like, then place the liquid crystal cell on a transmission type polarization microscope and make the measurement. At this time, it is necessary to set capacitances between the pixel electrodes and the common electrode (the liquid crystal capacitance and the capacitances of the alignment film and insulating film) equal in the simplified liquid crystal cell for measurement and in a liquid crystal display apparatus actually manufactured.

The amount of light passing through the liquid crystal display device is measured by use of a photodiode, photomultiplier or luminance meter. A voltage as shown in FIG. 3A is applied between the pixel electrode and the common electrode. If the liquid crystal display device has a switching element such as TFT, it is necessary to turn ON the switching element by applying a DC voltage of 20V to the gate line. A variation in the light intensity (light transmittance) caused at this time occurs as shown in FIG. 3B. The light intensity at the time of t=0 is set to T1 and the light intensity at the time of t=16.7 ms is set to T2. The response time $\tau$ can be obtained by deriving the time required for the light intensity to change by 90% or reach a value of $0.9\times(T2-T1)+T1$. If the absolute value of the application voltage is set to V and the response times are different at the time of changes of $0\rightarrow+V$, $+V\rightarrow0$, $0\rightarrow-V$ and $-V\rightarrow0$, the longest one of the response times is used as the response time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 3A and 3B are waveform diagrams for illustrating the definition of the response time of liquid crystal;

FIG. 4 is a block diagram showing the construction of a liquid crystal display apparatus according to a first embodiment of this invention;

FIGS. 8A to 8D are waveform diagrams drawn on the same time scale, for illustrating a method for driving the liquid crystal display apparatus according to a second embodiment of this invention, FIG. 8A showing the gate voltage of a scanning line, FIG. 8B showing the signal voltage of a signal line, FIG. 8C showing a write-in voltage applied to the pixel electrode, and FIG. 8D showing a holding voltage of the pixel electrode;

DETAILED DESCRIPTION OF THE INVENTION

Prior to explanation of embodiments of this invention, antiferroelectric liquid crystal which is one example of a liquid crystal material having spontaneous polarization induced by application of an electric field or inherent spontaneous polarization (which is hereinafter referred to as liquid crystal having spontaneous polarization) is explained.

Figure 1:
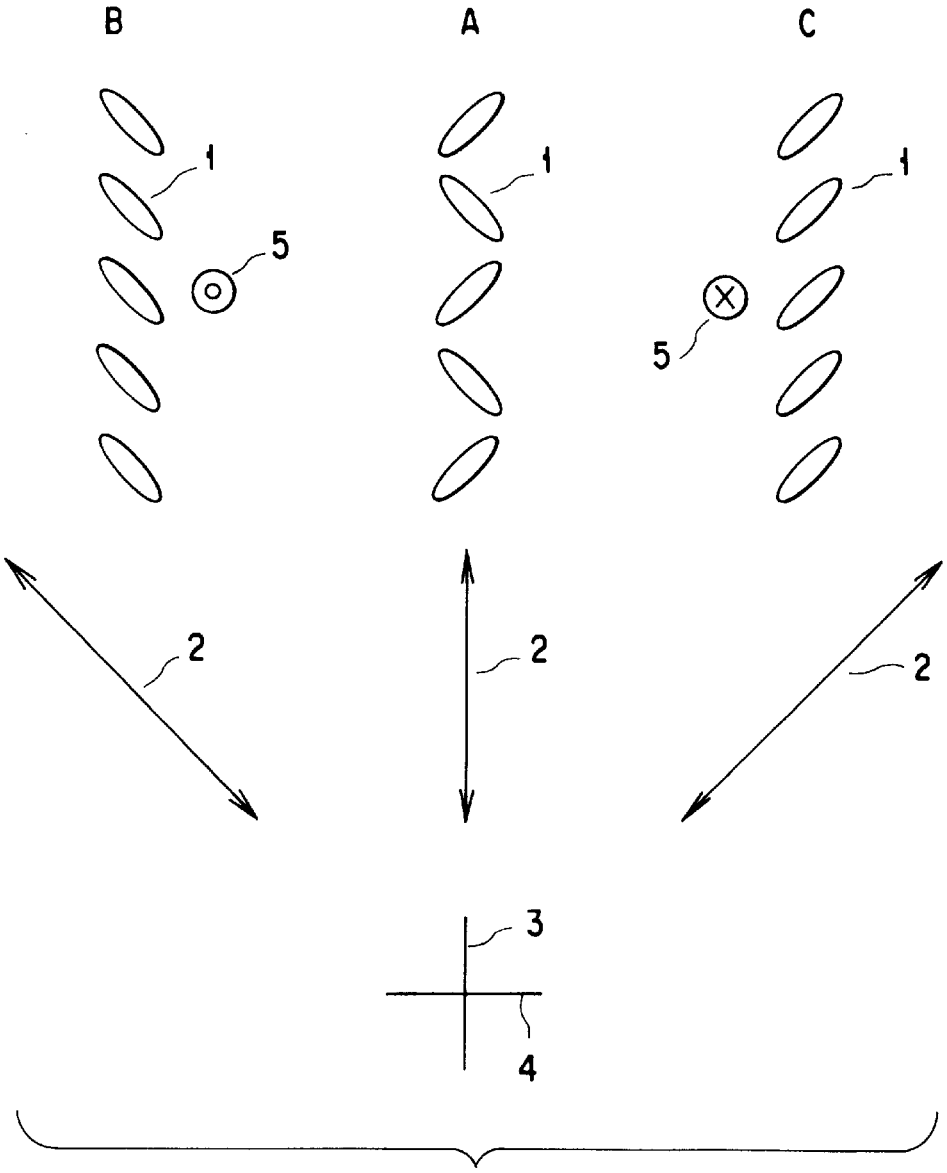
FIG. 1 is a diagram for illustrating the response of molecules with respect to an electric field in the liquid crystal having spontaneous polarization.

FIG. 1 shows the relation between the molecular alignment of thresholdless antiferroelectric liquid crystal (TLAF) and the electric field. Molecules 1 of the liquid crystal are alternately arranged in one of two different directions in the state A in which no voltage is applied so as to cancel the spontaneous polarization thereof. In this case, the average optical axis 2 of the molecules 1 is set in the vertical direction. Therefore, if two polarizing plates are arranged so as to be set in the same direction as the optical axis 2 and in the direction perpendicular to the optical axis, as indicated by direction lines 3 and 4 respectively, a dark state (normally black state) is set.

However, in a state B or C in which a positive voltage or negative voltage is applied, the molecules 1 of the liquid crystal are set in one direction according to the direction of the electric field 5 and the optical axis 2 is deviated from the polarizing direction of the polarizing plate and a bright state is set. That is, the thresholdless antiferroelectric liquid crystal is different from nematic liquid crystal in that the arrangement of the molecules of the liquid crystal are different in the positive voltage application state and the negative voltage application state.

Further, the thresholdless antiferroelectric liquid crystal can be set not only in the three states of orientation including the no voltage application state (state A), the positive voltage application state (state B), and the negative voltage application state (state C), but also in the intermediate states of desired orientation among the above states according to the magnitude and polarity of a voltage applied between the electrodes. Therefore, although a substantial memory performance is not provided, the gray scale display can be attained by applying the above liquid crystal to an active matrix type display apparatus having switching elements formed of active elements such as TFTs in a plurality of pixels and holding a voltage for setting the state of desired orientation during the non-selection period.

FIGS. 2A to 2H show voltages applied to one of the pixels and the light transmittance thereof, in a case where liquid crystal display apparatuses in which nematic crystal and liquid crystal having spontaneous polarization are disposed between the pixel electrodes arranged in a matrix form and the common electrode are driven in the active matrix type frame inversion driving mode. In this case, it is assumed that the polarizing plates are arranged to set the normally black state.

Figures 2A, 2B, 2C, 2D, 2E, 2F, 2G, 2H:
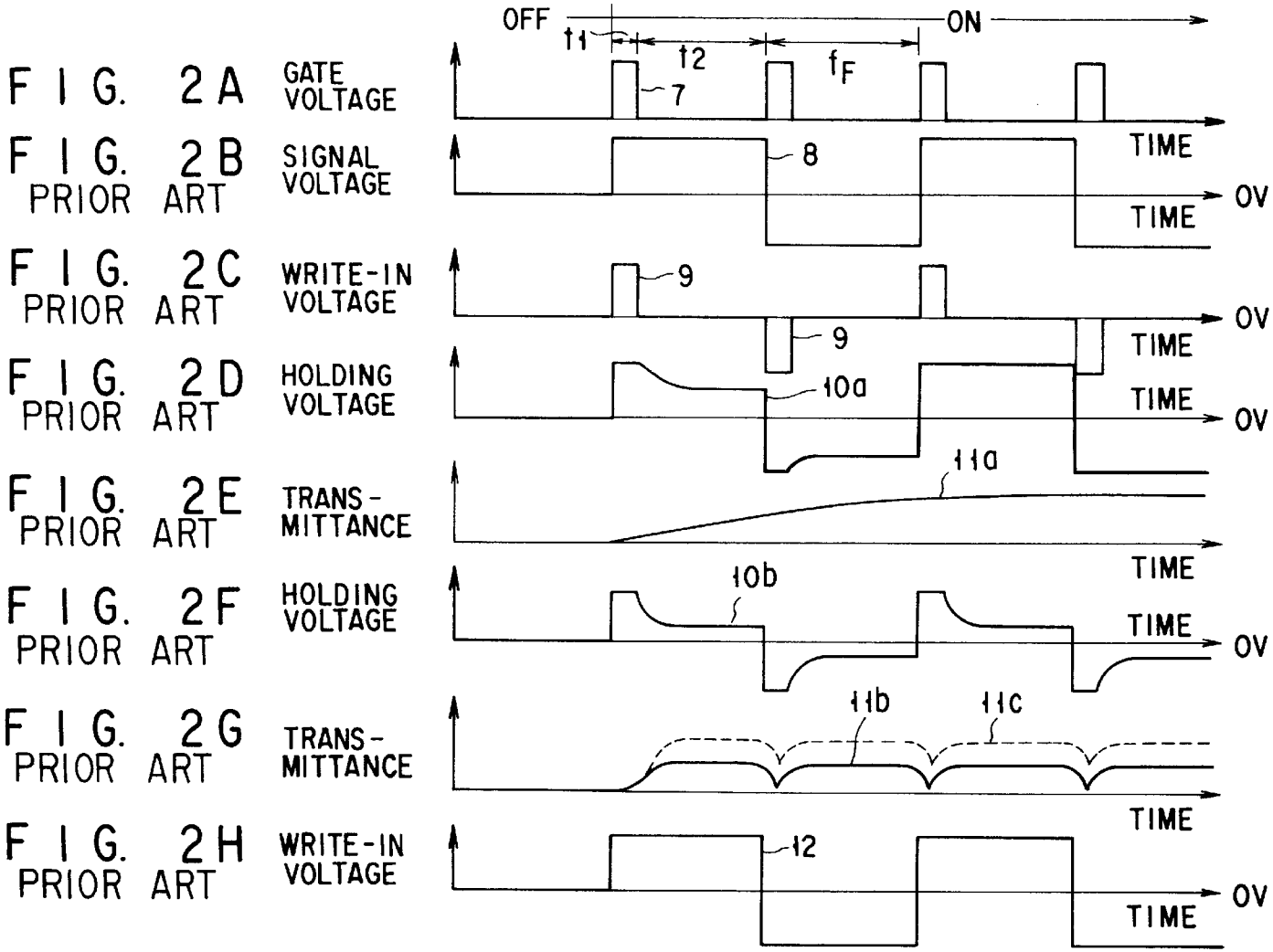
FIG. 2B PRIOR ART
FIG. 2C PRIOR ART
FIG. 2D PRIOR ART
FIG. 2E PRIOR ART
FIG. 2F PRIOR ART
FIG. 2G PRIOR ART
FIG. 2H PRIOR ART
FIGS. 2A to 2H are waveform diagrams for illustrating a method for driving the conventional liquid crystal display apparatuses, FIGS. 2A and 2B showing the gate voltage of a scanning line and the signal voltage of a signal line, FIGS. 2C to 2E showing a write-in voltage, holding voltage and transmittance of TN type liquid crystal, and FIGS. 2F to 2H showing a holding voltage of liquid crystal having spontaneous polarization, transmittance thereof and the write-in voltage, respectively.

In the nematic liquid crystal, it is assumed that a gate signal 7 is periodically input from the gate line as shown in FIG. 2A. In this case, the period of the gate signal 7 is set to correspond to a frame frequency $f_F$. Further, a signal voltage 8 whose polarity is inverted in a period corresponding to the frame frequency is applied to the signal line as shown in FIG. 2B (the potential $V_{COM}$ of the common electrode is displayed as 0V). If the gate signal is input and applied to the gate electrode of the switching element as described above, the switching element is kept in the ON state during a period ($t_1$) in which the gate signal is kept applied as shown in FIG. 2C, and the voltage of the signal line is supplied to the pixel electrode as a write-in voltage 9. Then, as shown in FIG. 2D, a holding voltage 10*a* of the nematic liquid crystal cell is kept substantially constant owing to the voltage supplied to the pixel electrode shown in FIG. 2C, since the liquid cell and the storage capacitor line function as a capacitor and the voltage holding rate is not substantially lowered.

That is, if impurity is contained in the liquid crystal, the holding voltage will be lowered, and when fluorine-based liquid crystal containing almost no ion impurity is used, the holding voltage can be kept substantially constant as in the above example. The light transmittance of the liquid crystal cell used in this case is shown in FIG. 2E. Since the response speed of nematic liquid crystal is low, the rise time of the light transmittance 11*a* becomes long, but the orientation of the liquid crystal is not influenced irrespective of whether the voltage held in the pixel electrode is positive or negative and the light transmittance 11*a* increases gradually to be kept substantially constant after several to tens of frames.

On the other hand, in the liquid crystal having spontaneous polarization, the write-in voltage 9 shown in FIG. 2C is supplied to the pixel according to the input of the gate signal 7 of FIG. 2A from the gate line and the voltage 8 of FIG. 2B applied to the signal line. In this case, as shown in FIG. 2F, a holding voltage 10*b* of the liquid crystal cell is lowered after the write-in operation and exhibits an extremely bad holding characteristic. Further, the light transmittance 11*b* of the liquid crystal cell exhibits a characteristic as indicated by solid lines in FIG. 2G.

If a write-in voltage 12 shown in FIG. 2H is supplied to the liquid crystal cell to perform the static driving operation, the light transmittance 11*c* indicated by broken lines in FIG. 2G is obtained. Thus, in the case of liquid crystal having spontaneous polarization, the light transmittance at the ON time is extremely lowered when the liquid crystal is driven in the active matrix driving mode than when it is driven in the static driving mode. As a result, the liquid crystal display apparatus using the liquid crystal having spontaneous polarization has a problem that the contrast is lowered and the display quality is degraded.

The inventors studied the above problem in detail and found that the problem was caused by the following reasons. That is, in the case of the active matrix driving mode, supply of a voltage for writing in one frame is effected only partly as shown in FIG. 2C. Generally, since the response time (80 μs or more) is longer than the write-in time (typically, 64 μs or less) in liquid crystal, the change of orientation of liquid crystal molecules is not completed within the write-in time $t_1$. Therefore, even in the remaining time $t_2$ after completion of the write-in operation, the change of orientation of liquid crystal molecules is continuously made by charges held in the storage capacitor, and the holding voltage is lowered as shown in FIG. 2D. At this time, the liquid crystal molecules cannot be changed to such a state of orientation which can be attained in the static driving mode and the transmittance is lowered in comparison with that attained in the static driving mode. Then, in the next frame, a voltage of the opposite polarity is written.

In the nematic liquid crystal having no spontaneous polarization, the liquid crystal molecules respond to the absolute value of the application voltage. That is, the same orientation is obtained at the time of application of +5V and at the time of application of −5V. Therefore, even if a change of orientation of liquid crystal made in the first frame in which the state is changed from the OFF state to the ON state is insufficient, a change of orientation of liquid crystal molecules is gradually made in the second, third frames, and after several frames to several tens of frames, the same state of orientation as that obtained by applying the same voltage in the static driving mode can be attained. That is, after the several frames to several tens of frames, the same transmittance as that attained in the static driving mode can be attained.

In the liquid crystal having spontaneous polarization, the orientation of liquid crystal molecules becomes different according to the polarity of a voltage applied. That is, the orientation becomes different at the time of application of +5V and at the time of application of −5V. Therefore, a certain state of orientation of liquid crystal molecules for positive polarity is attained in the first frame in which the state is changed from the OFF state to the ON state (since the response speed is low, the state of orientation does not reach the state of orientation attained by applying the same voltage in the static driving mode).

Since the polarity is inverted in the second frame, the orientation of liquid crystal molecules changes from the orientation for positive polarity attained in the first frame and passes through the state of orientation which is attained at the time of no voltage application. Therefore, like the case of the first frame in which the state is changed from the OFF state to the ON state, the orientation does not reach the orientation attained in the static driving mode. Since the polarity is inverted for each of the succeeding frames, the orientation does not reach the orientation attained by applying the same voltage in the static driving mode. As a result, the transmittance is significantly lowered in comparison with that attained in the static driving mode and the display is made with lowered contrast.

This invention has been made with the above problems taken into consideration and an object of this invention is to provide a liquid crystal display apparatus using liquid crystal having spontaneous polarization and capable of providing excellent image quality with high contrast.

There will now be described embodiments of this invention with reference to the accompanying drawings.

The construction of a liquid crystal display apparatus according to the embodiments of this invention is shown in FIG. 4. The liquid crystal display apparatus has a construction obtained by adding a polarity inversion controller 20 to the construction of a conventional active matrix type liquid crystal display apparatus using nematic liquid crystal.

That is, in the liquid crystal display apparatus, a display timing controller 23 to which a display signal 21 and a synchronizing signal 22 are input is connected to a signal line driver 25 which drives a liquid crystal display device 24 and a scanning line driver 26 and the display timing controller 23 is further connected to a polarity inversion controller 20 for adequately inverting the polarity of the display signal 21.

Figure 5A:
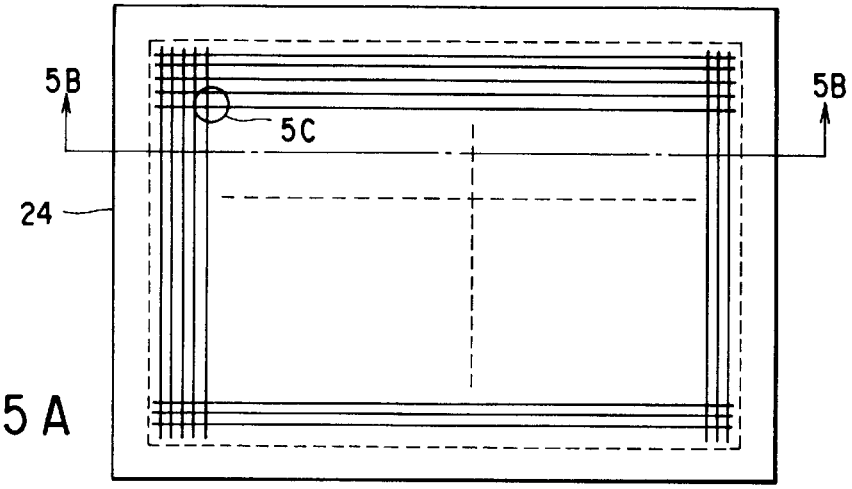
FIG. 5A is a conceptional plan view showing a liquid crystal display device which is one constituent part of the liquid crystal display apparatus according to the first embodiment.
Figure 5B:
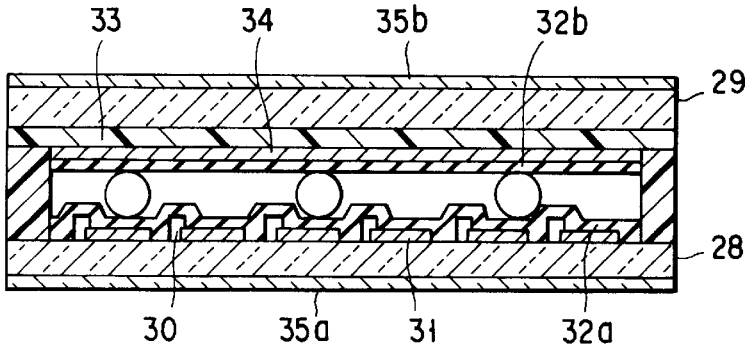
FIG. 5B is a cross sectional view taken along the line 5B—5B of FIG. 5A.

As shown in FIG. 5B, the liquid crystal display device 24 has switching elements 30 formed of TFTs arranged in a matrix form and pixel electrodes 31 formed of transparent conductive films such as ITO (Indium Tin Oxide) films on the inner side of a first substrate 28 which is one of a pair of glass substrates 28 and 29 facing each other and an alignment film 32*a* formed of polyimide resin or the like is formed on the switching elements 30 and pixel electrodes 31.

On the inner side of the second substrate 29, a color filter 33 is formed, a common electrode 34 formed of a transparent conductive film such as an ITO film is disposed on the color filter 33, and an alignment film 32*b* formed of polyimide resin or the like is formed on the common electrode 34. Liquid crystal having spontaneous polarization such as ferroelectric liquid crystal FLC, antiferroelectric liquid crystal AFLC, DHF, TFLC or TLAF is disposed between the switching elements 30 and pixel electrodes 31 formed on the first substrate 28 on one hand and the common electrode 34 formed on the second substrate 29 on the other. Further, polarizing plates 35*a* and 35*b* are respectively attached to the outer surfaces of the first and second substrates 28 and 29.

Figure 5C:
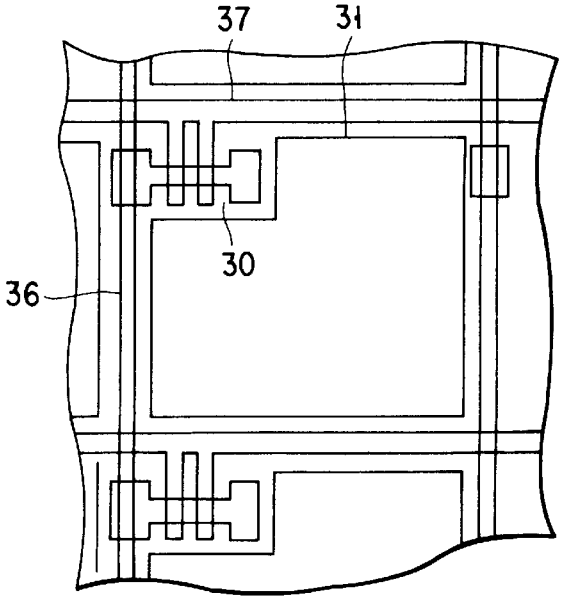
FIG. 5C is an enlarged view of a portion 5C in FIG. 5A.

A reference numeral 36 in FIG. 5C denotes a signal line, and 37 denotes a gate line. Further, in FIG. 5C, a Cs (storage capacitor) line is omitted.

In the liquid crystal display apparatus, a display signal and scanning signal are respectively supplied to the signal line driver 25 and scanning line driver 26 from the display timing controller 23 according to the synchronizing signal 22 input to the display timing controller 23. At this time, the polarity of the display signal is adequately inverted by use of the polarity inversion controller 20.

The polarity inversion of the display signal is effected as indicated by the following methods (a) to (e).

(a) The polarity of a voltage applied between the electrodes is inverted for every preset period of time TS which satisfies the expression of $TS/TF \geqq 2$ when the frame period is set to TF. Preferably, the polarity inversion is effected to satisfy an expression of $TS/TF \geqq \tau/TK \geqq 2$ when a response time of the liquid crystal is set to $\tau$ and a write-in time is set to TK.

According to the above method, the following effect can be obtained. A frame which comes immediately after completion of the polarity inversion is set to a first frame, and frames following the first frame are set to second, third frames. Then, if the response time $\tau$ of liquid crystal is longer than the write-in time TK, the response of liquid crystal molecules is not completed during the writing operation for the first frame. In this method, since a voltage of the same polarity is applied in the second and succeeding frames, the response operation of liquid crystal molecules further proceeds and the light intensity in the second and succeeding frames becomes higher than that attained in the first frame. As a result, the contrast is improved over the contrast attained in the AC driving mode (the polarity is changed for each frame).

(b) The write-in time for a pixel subjected to the polarity inversion is made longer than that for a pixel which is not subjected to the polarity inversion.

In the case of (a), since the light intensity is lowered by the polarity inversion, the light intensity in the first frame becomes low as a matter of course. If the area of a region to be subjected to the polarity inversion is large, the area of a region in which a lowering in the light intensity occurs becomes large and the lowering in the light intensity is visually recognized and the display quality is degraded. In the method of (b), since the write-in time for a pixel subjected to the polarity inversion is made longer, a lowering in the light intensity can be suppressed. For example, when liquid crystal having spontaneous polarization of $\tau$=150 $\mu$s is driven for Tk=42 $\mu$s, a lowering in the light intensity at the time of polarity inversion does not occur if the write-in time only for the pixel to be subjected to the polarity inversion is set to 200 $\mu$s.

(c) The amplitude of a signal at the time of polarity inversion is made larger than that when the polarity inversion is not effected.

In this method, since the absolute value (signal amplitude) of a voltage applied to a pixel to be subjected to the polarity inversion is made large, a lowering in the light intensity at the time of polarity inversion can be suppressed. For example, a case wherein liquid crystal having spontaneous polarization of=150 $\mu$s is driven for Tk=42 $\mu$s is considered. When the polarity is inverted from −5V to +5V, a voltage of $(5+\alpha)$V is applied only to a frame (first frame) subjected to the polarity inversion. During the writing operation, the orientation of liquid crystal molecules is changed towards the orientation attained when the voltage of $(5+\alpha)$ is applied in the static driving mode, but the change in the orientation is stopped on halfway since the response time is longer than the write-in time. If the state of orientation attained at this time is equivalent to the state of orientation attained by application of 5V in the static driving mode, a lowering in the light intensity at the time of polarity inversion does not occur. A lowering in the light intensity at the time of polarity inversion can be prevented by previously deriving values of $\alpha$ for all of the gray scales and increasing the signal amplitude by a corresponding value of a at the time of polarity inversion.

If a exceeds the limit of a voltage which the driver IC can output, it is preferable to suppress a lowering in the light intensity at the time of polarity inversion by using a combination of the methods of (b) and (c).

(d) The polarities of voltages applied between the electrodes of part of the pixels in one frame are inverted and the polarity inversion for all of the pixels is completed by sequentially changing the part of the pixels to be subjected to the polarity inversion.

The polarity inversion method includes a step of effecting the polarity inversion for at least one pixel in one frame and a step of effecting the polarity inversion for all of the pixels which lie on one scanning line, and the above methods are preferably effected such that positive polarity pixels and negative polarity pixels are present in substantially the same ratio in one frame.

If the polarity inversion is simultaneously effected for the entire portion of the frame, a lowering in the light intensity at the time of polarity inversion tends to be easily visually recognized. It is possible to make it difficult to visually recognize the lowering in the light intensity by reducing the area of a region subjected to the polarity inversion as indicated in the method (d). If the polarity inversion is effected for each pixel in each frame, it becomes most difficult to visually recognize the lowering in the light intensity.

When the polarity inversion is partly effected, the driving operation can be simplified if all of the pixels connected to one scanning line (gate line) are dealt with as one unit of polarity inversion. That is, pixels connected to an n-th gate line in a certain frame are subjected to the polarity inversion and pixels connected to an m-th gate line in a next frame are subjected to the polarity inversion. In this case, when the write-in time at the time of polarity inversion is made longer as in the case of the method (c), it is only required to elongate the ON-state time of the gate line to be subjected to the polarity inversion, and therefore, this method can be easily attained.

The operation of effecting the polarity inversion for two or more frames may be effected in a portion of one image plane and the normal polarity inverting operation may be effected for each frame in the other portion of the image plane. Further, the polarity inversion for two or more frames may be effected in part of the period on the time base and the normal polarity inverting operation for each frame may be effected in the other period.

Since liquid crystal having spontaneous polarization has anisotropy which is optically uniaxial, the light intensity and color are changed when viewing the liquid crystal display device in an oblique direction at the time of positive voltage application and at the time of negative voltage application even if the absolute value of the application voltage is equal. In order to suppress the above change, it is preferable to drive the liquid crystal based on the signal line inversion or dot inversion and it is preferable to set the ratio of the pixels to which a voltage of positive polarity is applied to the pixels to which a voltage of negative polarity is applied to approximately 1:1. Specifically, it is preferable to set the ratio of the number of pixels of positive polarity to the number of pixels of negative polarity within a range of 0.5 to 2 in a desired area of 3 mm×3 mm in one image plane.

The intensity and color of transmission light are changed according to the polarity of a voltage applied to the liquid crystal molecules when viewing the liquid crystal display device in an oblique direction. When the signal line inversion or dot inversion is effected, changes in the intensity and color of transmission light caused when viewing the liquid crystal display device in an oblique direction are compensated for by adjacent signal lines or pixels and the viewing angle becomes wide. When part of the image plane (frame) is subjected to the polarity inversion, a balance between the pixels of positive polarity and the pixels of negative polarity cannot be maintained, the above compensating effect cannot be attained, and an irregular pattern may be sometimes observed when viewing the liquid crystal display device in an oblique direction. In order to prevent this, it is preferable to effect the polarity inversion while the ratio of the number of pixels of positive polarity/the number of pixels of negative polarity is set within a range of 0.5 to 2 in a desired area of 3 mm×3 mm in an image plane (in this range, the irregular pattern will not cause any substantial problem).

More preferably, the polarity inversion is effected while the ratio of the number of pixels of positive polarity/the number of pixels of negative polarity is set within a range of 0.75 to 1.33 in a desired area of 2 mm×2 mm in one image plane. As a result, no irregular pattern is observed even if the liquid crystal display device is viewed in any direction.

(e) The surface portion of the alignment film of the liquid crystal display device is formed to have an electrically conductive property and the polarity inversion of a voltage applied between the electrodes is effected for every preset frame period.

According to this method, if a large amount of impurity is present in the liquid crystal material and image sticking occurs, the image sticking can be suppressed.

Further, if the period of polarity inversion is made longer, the number of times by which charges are charged on or discharged from capacitor components such as the storage capacitor and liquid crystal cells is reduced and the power consumption can be reduced.

Next, a concrete embodiment of the driving method according to this invention is explained.

(First Embodiment)

When the liquid crystal cell 24 in which liquid crystal having spontaneous polarization is disposed between the pixel electrodes arranged in a matrix form and the common electrode as shown in FIGS. 5A to 5C is driven by use of the circuit construction shown in FIG. 4, the driving operation is effected to satisfy the following expression. That is, the expression of $TS/TF \geqq \tau/TK \geqq 2$ is satisfied when the frame period is set to TF, the response time of the liquid crystal is set to $\tau$, the write-in time is set to TK and the polarity of a voltage applied between the electrodes is inverted for each preset period TS.

In this case, the frame frequency fF and the frame period TF are set in the relation of $TF=1/fF$ and the term $\tau/TK$ in the above expression indicates an amount by which the response time is longer than the write-in time.

For example, if liquid crystal whose response time $\tau$ is 120 $\mu$s is used when the write-in time TK is 60 $\mu$s, the relation of $\tau/TK=2$ is obtained and indicates that time which is twice the write-in time is taken for response. Therefore, in order to lengthen the period of the polarity inversion of a display signal by a corresponding amount, it is necessary to satisfy the expression of $TS/TF \geqq \tau/TK=2$, and the satisfactory result can be attained if the polarity inversion is effected for every two or more frames.

FIGS. 6A to 6F show signal waveforms in a case wherein the polarity inversion is effected for every two frames, for example.

Figures 6A, 6B, 6C, 6D, 6E, 6F:
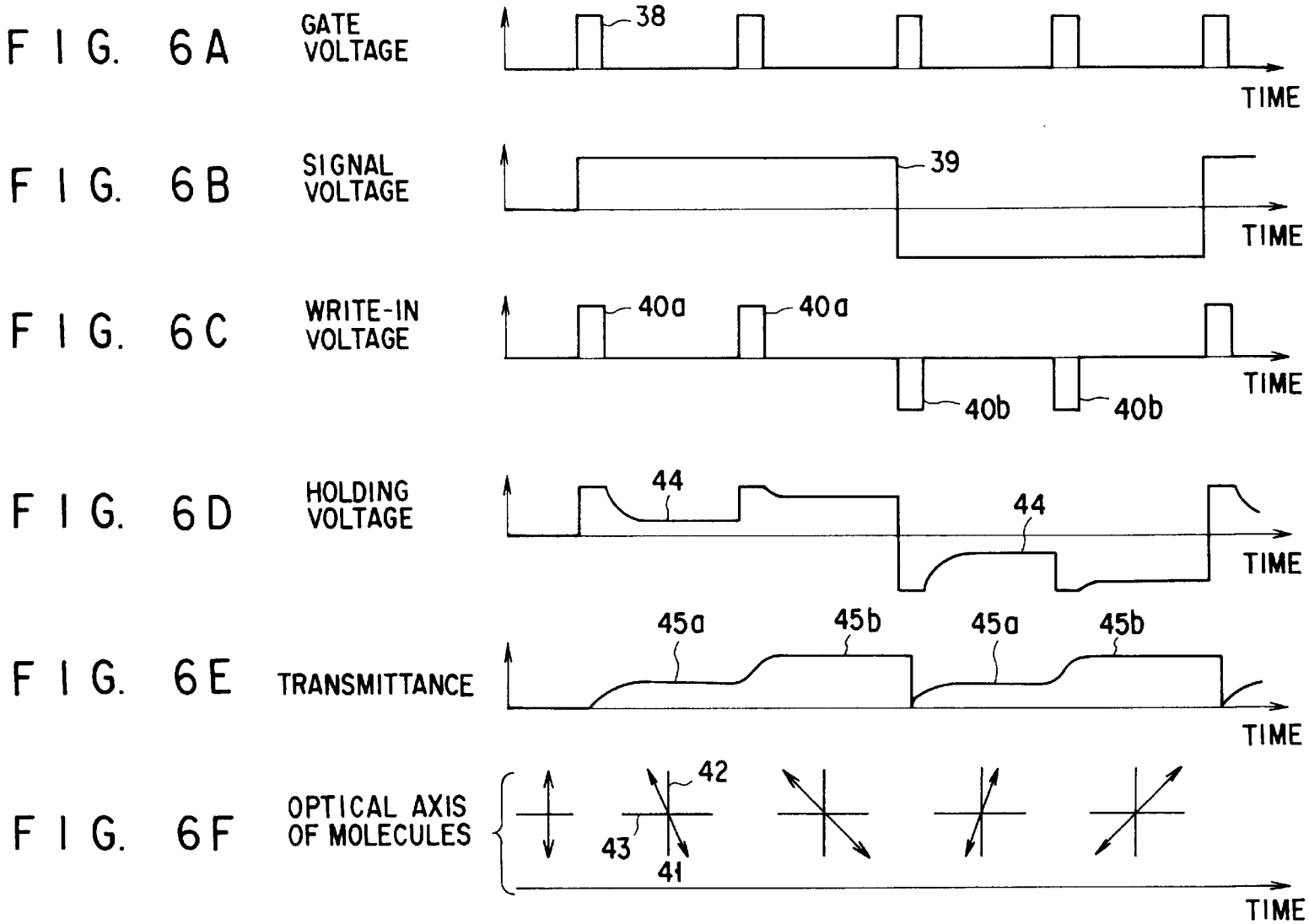
FIGS. 6A to 6F are waveform diagrams drawn on the same time scale, for illustrating a method for driving the liquid crystal display apparatus of the first embodiment, FIG. 6A showing the gate voltage of a scanning line, FIG. 6B showing the signal voltage of a signal line, FIG. 6C showing a write-in voltage applied to the pixel electrode, FIG. 6D showing a holding voltage of the pixel electrode, FIG. 6E showing the transmittance of liquid crystal, and FIG. 6F showing the optical axis of liquid crystal molecules.

As shown in FIG. 6A, a gate signal 38 is periodically input from the gate line, and as shown in FIG. 6B, a display signal voltage 39 whose polarity is inverted for each period which is twice the period of the gate signal or for every two frames is applied to the signal line (the potential of the common electrode is displayed as 0V). At this time, as shown in FIG. 6C, if the display signal is set at the ON level in the first frame and a positive voltage 40*a* is applied to the pixel electrode, the optical axis 41 of the liquid crystal molecules is deviated from the polarizing directions 42 and 43 as shown in FIG. 6F and the bright state is set.

In the second frame, the positive voltage 40*a* is also applied to the pixel electrode and the same bright state is kept. A variation in a holding voltage 44 set at this time is shown in FIG. 6D. In this case, since time required for the orientation of the liquid crystal molecules to be completely changed is longer than the write-in time, the change of orientation is not completed within the write-in time of the first frame, and the transmittance of the second frame becomes higher than that of the first frame as indicated in FIG. 6E by 45*a* and 45*b* which respectively denote the transmittances of the first and second frames.

Then, in the third frame, the display signal is inverted and a negative voltage 40*b* is applied to the pixel electrode. In response to the above signal inversion, the holding voltage 44 is changed as shown in FIG. 6D. In this case, the orientation of the liquid crystal molecules changes from the orientation of positive electric field to the orientation of negative electric field via the orientation of no electric field (refer to FIG. 1). Since time required for the above change of orientation is longer than the write-in time, the change of orientation is not completed within the write-in time. Therefore, as shown in FIG. 6E, the transmittance 45*a* is lowered. Since the negative voltage is also applied in the fourth frame, the change of orientation of the liquid crystal molecules which has not been completed in the third frame can be substantially completed during the write-in time in the fourth frame and the high transmittance 45*b* which is substantially equivalent to the transmittance obtained in the static driving mode can be attained.

As a result, gray scales can be clearly displayed with high contrast. Further, according to the above driving method, it is only required to lengthen the period of polarity inversion of the display signal 39, the driving circuit can be constructed without adding a driver IC or greatly changing the circuit design. Further, since the number of times of polarity inversion is reduced, the power consumption can be lowered.

In the above explanation, the voltage of the display signal 39 is set at the same level in the first and second frames and at the other level in the third and fourth frames, but in practice, it is necessary to change the level according to an image displayed in each frame. For example, if an image which gradually becomes brighter is displayed, the signal voltage may be changed such that the voltage will be set to +2V in the first frame, +3V in the second frame, −5V in the third frame, and −6V in the fourth frame.

In the first embodiment, the polarity inversion of the display signal applied to the pixel electrode is effected for every two or more frames, but the optimum upper limit of the period of the polarity inversion of the voltage applied to the pixel electrode can be determined according to the amount of ion impurity contained in the liquid crystal and the degree of ease with which the alignment film can be charged.

That is, if a voltage of the same polarity is continuously applied to the pixel electrode, ion material contained in the liquid crystal moves to the interface between the alignment film near the pixel electrode and the liquid crystal to charge the alignment film. As a result, the effective electric field applied to the liquid crystal is lowered and an image sticking phenomenon that the preceding display image slightly remains occurs when the display image is changed. In order to prevent the image sticking, for example, it is desirable to invert the polarity of a voltage of the display signal applied to the pixel electrode within 60 minutes, preferably, 5 minutes when the alignment film is formed of polyimide resin, for example.

For polarity inversion of the display signal, it is desirable to provide a change-over switch so as to easily change the polarity. For example, when the same image screen is displayed for a relatively long time as in the image screen of a personal computer, it is preferable to set the period for polarity inversion long, and when a video image such as an image on TV or video player which moves quickly is displayed, it is preferable to set the period for polarity inversion closer to the frame period, and thus it is preferable to make a design such that the period for polarity inversion can be adequately and selectively set according to the purpose of application of the liquid crystal display apparatus.

Further, in the first embodiment, if the polarity is inverted for every n frames, a frequency component having a frequency of 1/(2n) of the frame frequency is generated. For example, if the frame frequency is 60 Hz and the polarity inversion of the display signal is effected for every two frames, a frequency component of 15 Hz is generated in the transmittance response and the frequency component of 15 Hz may be observed as flickers in some cases. Therefore, in such cases, it is possible to make it difficult to observe the flickers by driving the liquid crystal display device while changing the polarities of the respective pixel electrodes 31 as is explained with reference to FIGS. 7A to 7F by using the adjacent four pixel electrodes 31 in the first to fourth frames F1 to F4 as an example. Particularly, in a case where pixel electrodes on a plurality of scanning lines (gate lines) are simultaneously driven as in a case of dual scanning system, it is preferable to use the polarity inversion system shown in FIG. 7C.

Next, a concrete evaluation example of the first embodiment is explained.

(Evaluation Example 1)

First, a first substrate having TFT elements and pixel electrodes formed in a matrix form and a second substrate having a color filter and a black matrix formed thereon were prepared. The construction of the TFT element used for the evaluation sample is explained with reference to FIG. 5C.

A gate electrode 37 formed on the first substrate is covered with a gate insulating film having a laminated structure of a gate oxide film and a silicon oxide film and a semiconductor thin film formed of amorphous silicon thin film is formed on the gate insulating film.

A channel protection film formed of a silicon nitride film for protecting the semiconductor thin film at the time of channel formation is formed on the semiconductor thin film. Source electrodes electrically connected to the semiconductor thin film via an ohmic contact layer and drain electrodes integrally formed with the signal line are formed on the semiconductor thin film and channel protection film. Further, the source electrodes are electrically connected to the pixel electrodes.

The switching elements (TFTs) 30 of the above structure, signal lines 36, gate lines 37 and pixel electrodes are covered with a protection film formed of silicon oxide or silicon nitride. By thus covering the signal lines 36 and pixel electrodes with the protection film, occurrence of defects caused by the short circuit with the common electrode on the second substrate can be suppressed.

Next, the second substrate is explained. On the inner side of the second substrate, a color filter and black matrix are formed. A resin layer (formed of acrylic resin, benzocyclobutene polymer, polyimide or the like) is coated on the structure to make the substrate surface flat. Further, the common electrode formed of a transparent conductive film such as ITO is formed on the resultant structure. The common electrode is not formed on the entire surface of the substrate. That is, portions of the common electrode which face the signal lines and TFT elements on the first substrate when the first and second substrates are set to face each other are removed by a PEP process. With this structure, the common electrode can be prevented from being short-circuited to the signal line and TFT element via dusts or projections of the color filter.

In a case wherein the common electrode is formed on the entire surface of the second substrate, the waveform of a signal applied to the signal line becomes dull since a dielectric film (liquid crystal material and alignment film) is disposed between the common electrode and the signal line, but in the structure of this embodiment, since the common electrode is not formed on the signal line, the waveform will not become dull. The short circuit and the dull portion of the waveform will cause a more serious problem as the cell gap (distance between the first and second substrates) is smaller. In the present evaluation example, the cell gap is set to 2 $\mu$m, but if the cell gap is set to such a small value, it is extremely effective to partly remove the common electrode.

A thin film of fusible polyimide (AL-1051 made by Japan Synthetic Rubber Co., Ltd.) is offset-printed as an alignment film on the first substrate having the TFT elements formed thereon and the second substrate having the color filter and black matrix formed thereon and the structure is baked for three minutes at 90° C. and further baked for 30 minutes at 200° C. in an atmosphere of nitrogen.

The polyimide alignment film (film thickness 40 nm) thus formed is subjected to the rubbing process. At this time, the first and second substrates are subjected to the rubbing process while being heated at 100° C. As a result, stepped portions caused by the TFTs and the like can be fully subjected to the rubbing treatment. The rubbing directions are set in antiparallel for the first and second substrates and the cross rubbing angle is set at 5 degrees.

Next, spacer particles (diameter:2 $\mu$m) are scattered on the first substrate. The spacer particle is formed by coating organic resin on a core of silica ($SiO_2$). Further, an ultraviolet-setting sealing material is printed on the peripheral portion of the second substrate. In order to reduce the injection time, it is preferable to provide two or more injection ports. The first and second substrates are placed to face each other and combined together and ultraviolet rays are applied to set or cure the sealing material while they are pressed to each other. After this, the sealing material is completely set or cured by heating the same at 160° C. for one hour so as to complete the liquid crystal cell.

The liquid crystal cell is put into a vacuum chamber and thresholdless antiferroelectric liquid crystal composition (which has a phase series changing in an order of solid phase→−30° C.→smectic C phase→80° C.→smectic A phase→85° C.→isotropy and whose response time is 80 $\mu$s) is introduced via the injection port under the vacuum condition while it is heated at 120° C. After this, the injection port is sealed with epoxy-series adhesive. The cell gap of the thus formed cell was 2 $\mu$m.

A polarizing plate is attached to the outer surface of the first substrate such that the transmission axis of the polarizing plate may be set substantially perpendicular (approximately 92.5 degrees) to the rubbing direction. Further, a sheet-form heater is attached to the outer surface of the second substrate and a polarizing plate is attached to the heater on the substrate such that the transmission axis of the polarizing plate may be set in substantially parallel (approximately 2.5 degrees) to the rubbing direction. The sheet-form heater is formed of a transparent conductive film such as ITO formed on a glass or plastic substrate and is provided to heat the liquid crystal so as to attain high display quality even in an application environment of 0° C. or less.

The thus formed liquid crystal display device of 15-inch width in the diagonal direction (15-inch width across corners) is subjected to the voltage application alignment process for gradually cooling the liquid crystal display device from 90° C. to the room temperature for 30 minutes while a DC voltage of 25V is applied to the gate line to keep the gates in the ON state, a rectangular waveform (10 Hz) of ±10V is applied to the signal line and 0 V is applied to the common electrode. As a result, the liquid crystal orientation is made uniform.

A driving circuit is mounted on the above liquid crystal display device. Further, a back light is mounted on the outer surface of the first substrate and the whole structure is put into a casing to complete the liquid crystal display apparatus. The sheet-form heater also has a function of a protection plate (shock absorption plate) for preventing destruction of the orientation of the liquid crystal. Destruction of the orientation means that the orientation of the liquid crystal molecules is disturbed by strongly pressing the liquid crystal display device by fingers or the like.

The liquid crystal display device was driven under a condition of the frame frequency 60 Hz, the frame period 16.67 ms and the write-in time 64 $\mu$s and the polarity inversion was effected at every 33.33 ms in order to invert the polarity of the display signal applied to the pixel electrode for every two frames. As the result, it was proved that the contrast ratio was significantly improved to 80:1. In a case wherein the polarity of the display signal was inverted for each frame (16.67 ms), the contrast ratio was 10:1.

Figures 7A, 7B, 7C, 7D, 7E, 7F:
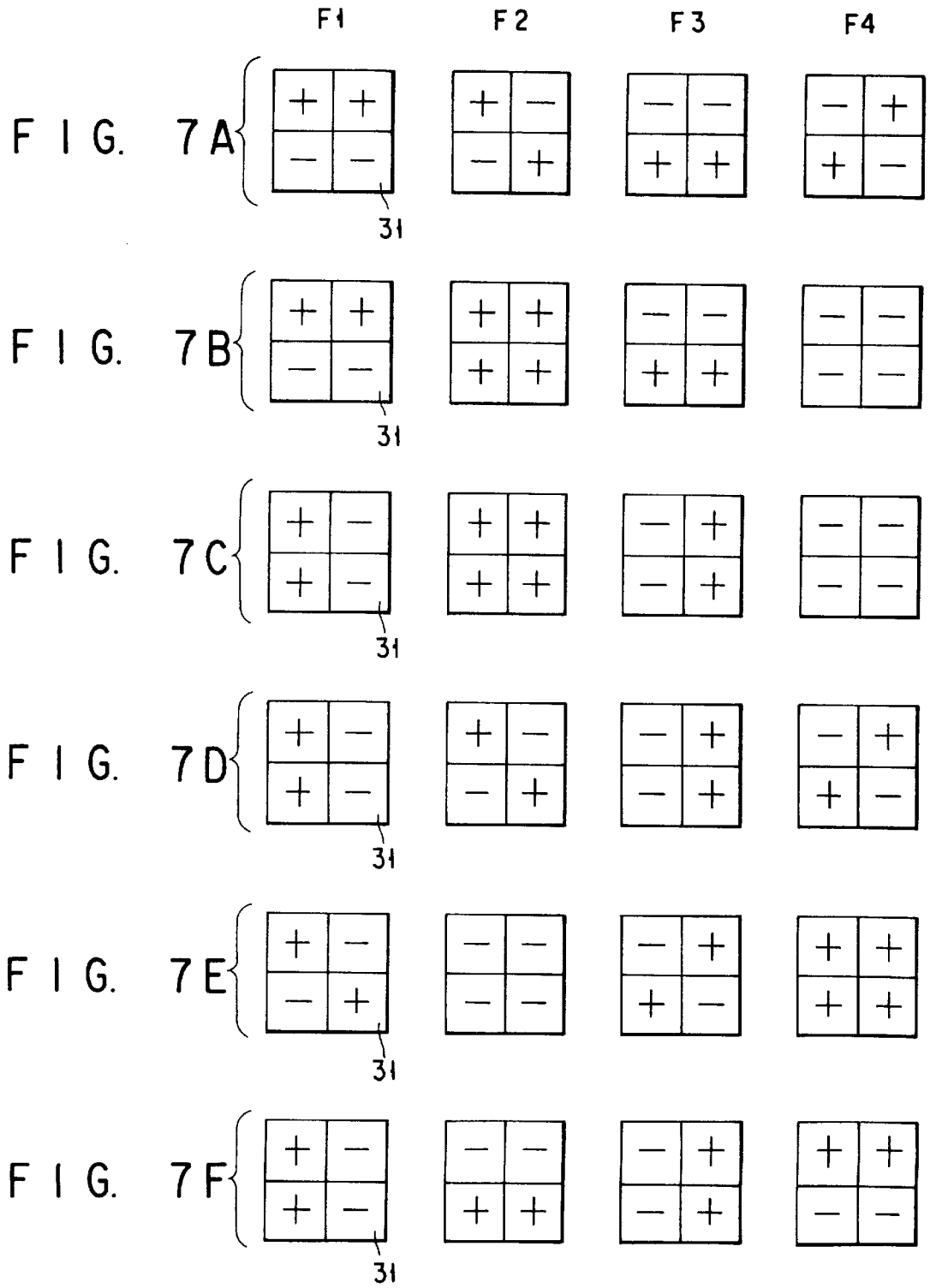
FIGS. 7A to 7F are diagrams showing several types of methods for inverting the polarity of the pixel electrode in the first embodiment, F1 to F4 showing continuous four frames.

Further, a liquid crystal display apparatus could be obtained which were free from afterimage and image sticking and had an extremely satisfactory display characteristic and in which no flickers were observed at all and the viewing angle was made large when the polarity was inverted among the adjacent pixel electrodes based on a relation as shown in FIG. 7E.

(Evaluation Example 2)

Next, a cell was formed in the same manner as in the evaluation example 1 except a step of subjecting the alignment film to the rubbing process while heating the same at 140° C. and a liquid crystal display device with 10-inch width in the diagonal direction was formed by injecting DHF liquid crystal (response time:150 $\mu$s) into the cell.

The thus obtained liquid crystal display device was driven in a dual scanning condition of the frame frequency 60 Hz and frame period 16.67 ms. In this case, the write-in time was set to 128 $\mu$s, and the same signal line was connected thereto during the first half period of 64 $\mu$s of the write-in period after the gate was turned ON and the same signal voltage as that applied to a pixel electrode whose gate was turned ON earlier by one scanning time (t1) was applied. Further, in order to invert the polarity of the display signal applied to the pixel electrode for every two frames, the polarity inversion was effected at every 33.33 ms. As the result, it was proved that the contrast was significantly improved to 80:1. In a case wherein the polarity of the display signal was inverted for each frame (16.67 ms), the contrast was 9:1.

Further, a liquid crystal display apparatus could be obtained which were free from afterimage and image sticking and had an extremely satisfactory display characteristic and in which no flickers were observed at all and the viewing angle was made large when the polarity was inverted among the adjacent pixel electrodes based on a relation as shown in FIG. 7C. In this case, since the inversion method is a vertical-line inversion method, the dual scan driving operation can be effected.

(Evaluation Example 3)

Next, a cell was formed in the same manner as in the evaluation example 1 except a step of subjecting the alignment film to the rubbing process while heating the same at 50° C. and a liquid crystal display device with 10-inch width in the diagonal direction was formed by injecting antiferroelectric liquid crystal (response time:65 μs) into the cell.

The thus obtained liquid crystal display device was driven in a condition of the frame frequency 60 Hz, frame period 16.67 ms and write-in time 32 μs, and in order to invert the polarity of the display signal applied to the pixel electrode for every five minutes, the polarity inversion thereof was effected for every five minutes.

As the result, it was proved that the contrast was significantly improved to 100:1. In a case wherein the polarity of the display signal was inverted for each frame (16.67 ms), the contrast was 10:1. In this case, the liquid crystal formed of organic compound with fluorine element containing substantially no ion impurity was used, and the resistivity was set to as high as $10^{15}$ Ω·cm and no image sticking occurred even if the polarity inversion of five minutes was not effected.

(Evaluation Example 4)

As a fourth evaluation example, the following liquid crystal display device was formed.

A thin film of soluble polyimide (having a small pre-tilt angle) is offset-printed as an alignment film on a first substrate having TFTs and pixel electrodes arranged in a matrix form and a second substrate having a color filter and black matrix formed thereon and the structure is baked at 90° for 30 minutes by use of a hot plate. Then, the thus formed polyimide alignment film (film thickness:65 nm) is subjected to the rubbing process.

Next, spacer particles are scattered on the first substrate. Further, an ultraviolet-setting sealing material is printed on the peripheral portion of the second substrate. The first and second substrates are placed to face each other and combined together and ultraviolet rays are applied to set or cure the sealing material while they are pressed to each other, and then, the sealing material is heated at 160° C. for one hour to form a cell. The cell is inserted into a vacuum chamber and thresholdless antiferroelectric liquid crystal composition (response speed τ=80 μs) is injected via the injection port, and then the injection port is sealed with epoxy-series adhesive. Further, polarizing plates are attached to the opposite surfaces of the cell to complete a liquid crystal display device with 10-inch width in the diagonal direction.

The thus formed liquid crystal display device was driven in the following condition. The definition of the image plane was XGA (the number of scanning lines:768), the frame frequency was 60 Hz, the frame period was 16.67 ms, and the write-in time was set to 42 μs since the image plane was divided into upper and lower two portions and driven.

When a video image which moved quickly as in the baseball broadcasting was displayed on the entire portion of the image plane, the polarity of a voltage applied between the pixel electrodes was inverted for every two frames. As a result, the contrast was significantly improved to 50:1 when the polarity inversion was effected for every two frames (33.33 ms) although the contrast was 20:1 when the polarity inversion was effected for each frame (16.67 ms).

Further, when a video image which moved slowly as in the text broadcasting was displayed on part of the image plane (display section 1) and a video image which moved quickly as in the baseball broadcasting was displayed on the other display portion (display section 2), the polarity was inverted for every two frames in the display section 1 and the polarity was inverted for each frame in the display section 2. As a result, high contrast could be attained in the display section 1 and a video image which moved quickly could be observed without the trail of the image in the display section 2 although the contrast was low. That is, when the response time τ of the liquid crystal is longer than the write-in time TK and the polarity is changed for every two frames, the response of the liquid crystal is not completed within a frame period in which the polarity inversion is effected and the liquid crystal molecules respond in a next frame in which a voltage of the same polarity is applied. That is, the responce time of the liquid crystal is lengthened to approximately 33.3 ms (which is the length of two frames). When the polarity inversion is effected for each frame, the response time will not exceed 16.7 ms (which is the length of one frame). As a result, if a voltage of the same polarity is applied for a plurality of frames and when a video image which moves quickly as a video image of a ball flying in the baseball is observed, the ball sometimes looks with a trail thereof.

The portion of the image plane in which the polarity inversion is effected for each frame and the portion in which the polarity inversion is effected for every two or more frames may be determined according to an image which the user of the liquid crystal display apparatus wants to watch or the display section 1 and the display section 2 may be automatically set after detecting the motion speed of an image based on a variation amount of the input signal 21.

In a case where the image plane is divided into n regions, the area of an i-th region is Ai and the polarity inversion therefor is effected for every m frames, then the average value is derived for the entire portion of the image plane and Ts can be defined as indicated by the following equation.

$$TS = \left(\sum_{i=1}^{n} Ai \times mi\right) \Big/ \sum_{i=1}^{n} Ai \tag{1}$$

(Second Embodiment)

In the first embodiment, a case wherein the polarity of the display signal applied to the pixel electrode is inverted for every preset time TS which satisfies the expression of TS/TF≧τ/TK≧2, preferably, for every two or more frames in order to prevent a lowering in the contrast caused when the polarity of the display signal is inverted is explained, but in the present embodiment, as shown in FIG. 8A, the polarity inversion of a display signal 39 applied to the pixel electrode is effected for every two or more frames, and as shown in FIG. 8C, the periods of supply time of voltages 40*a* and 40*b* applied to the pixel electrode when the polarity is inverted are set longer than the periods of supply time set when the polarity is not inverted.

With the above setting, in the case of images having a vertical correlation, for example, it is possible to preliminarily drive a present line in a period of driving time for a preceding line and then completely drive the present line. Therefore, the period of driving time can be set to twice the normal period at maximum. Since the above operation is effected only at the time of polarity inversion, it becomes possible to reduce the number of portions in which the contrast is momentarily lowered. As a result, the number of flickers caused when the polarity of the display signal is inverted can be reduced and a lowering in the contrast can be prevented, thereby making it possible to display an image with high image quality.

Figures 9A, 9B, 9C, 9D:
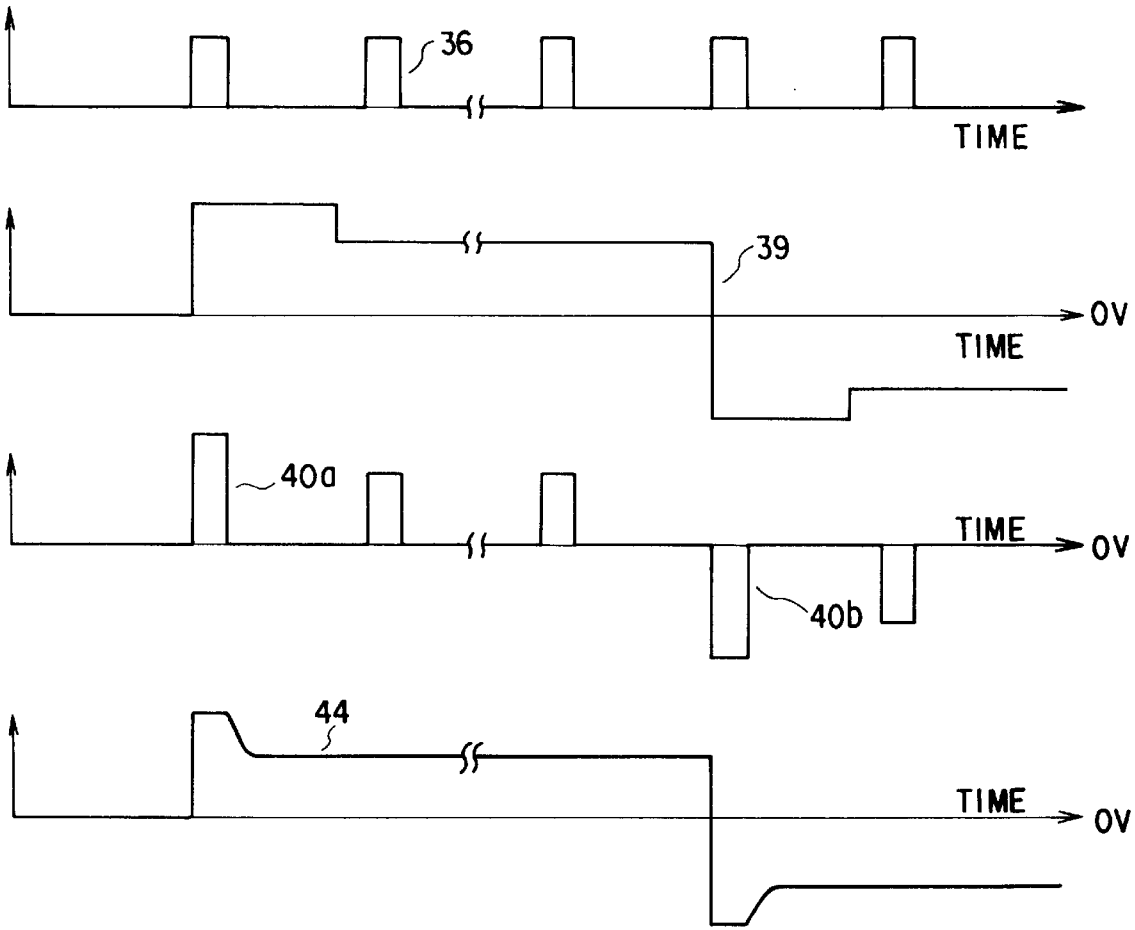
FIGS. 9A to 9D are waveform diagrams drawn on the same time scale, for illustrating a method for driving the liquid crystal display apparatus according to a modification of the second embodiment of this invention, FIG. 9A showing the gate voltage of a scanning line, FIG. 9B showing the signal voltage of a signal line, FIG. 9C showing a write-in voltage applied to the pixel electrode, and FIG. 9D showing a holding voltage of the pixel electrode.

The same effect as that obtained by lengthening the write-in time at the time of polarity inversion can be attained by increasing the absolute value of the write-in voltage at the time of polarity inversion as shown in FIG. 9B. That is, the voltage held on the pixel electrode is kept substantially constant as shown in FIG. 9D.

(Third Embodiment)

Figure 10:
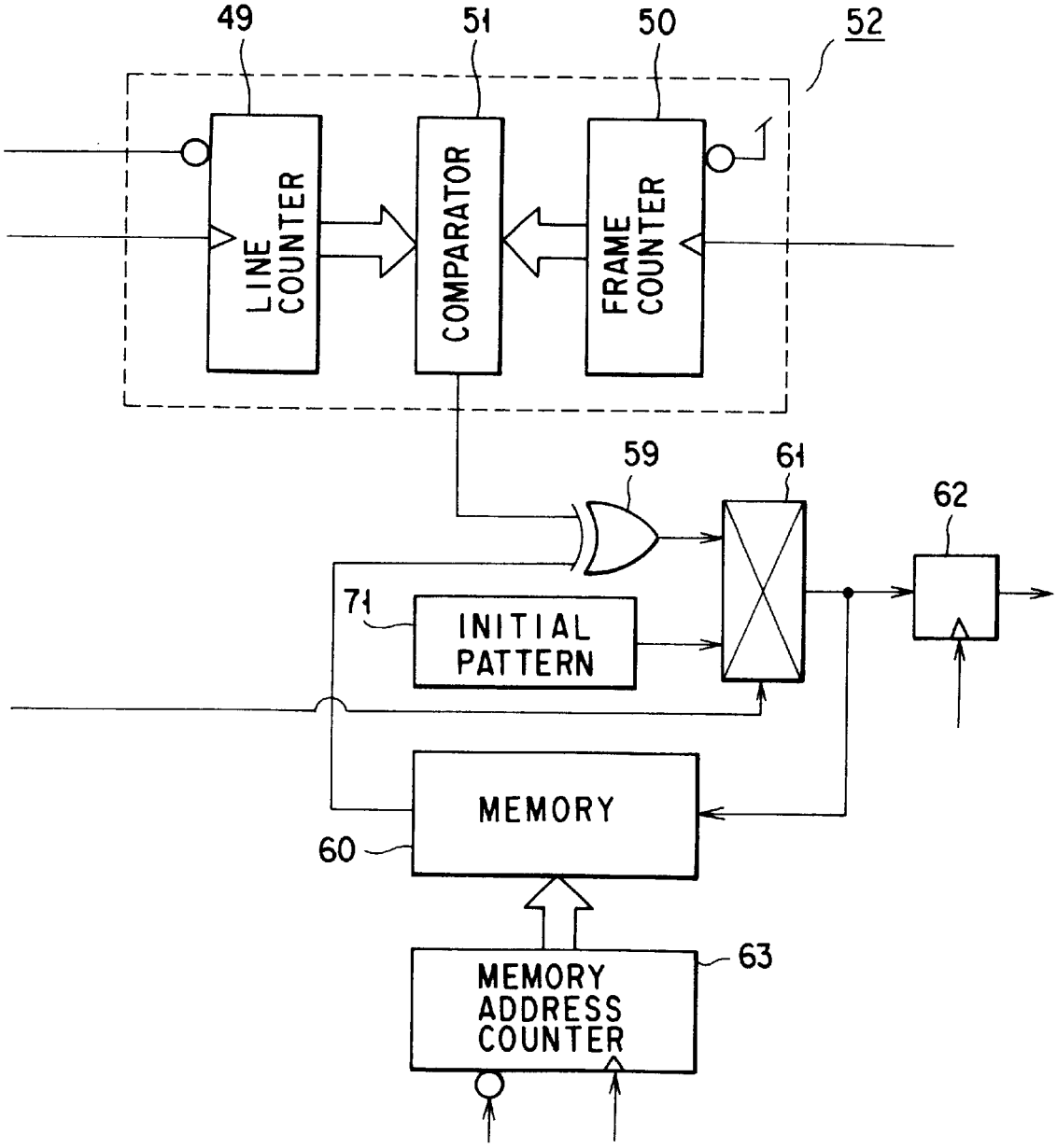
FIG. 10 is a block diagram showing the construction of a polarity inversion controller for controlling the polarity inversion of the pixel electrode in a third embodiment of this invention.
Figures 11A, 11B, 11C, 11D, 11E, 11F, 11G:
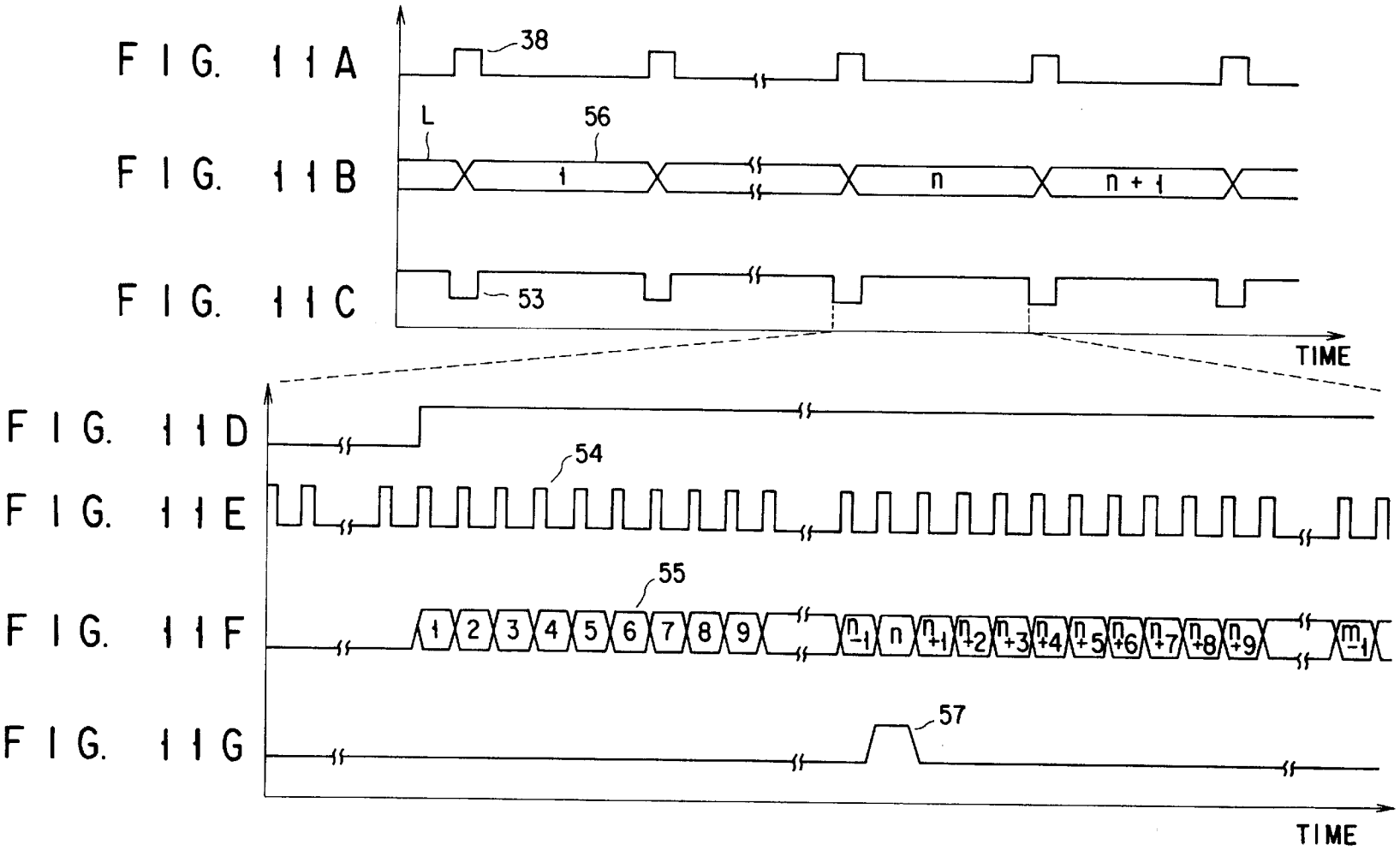
FIGS. 11A to 11G are waveform diagrams for illustrating a method for inverting the polarity of the pixel electrode in the third embodiment.

The construction of the polarity inversion controller 20 of the liquid crystal display apparatus shown in FIG. 4 is shown as the construction of a liquid crystal display apparatus of the third embodiment in FIG. 10, and the timing charts for illustrating the operation of the polarity inversion controller 20 are shown in FIGS. 11A to 11G. FIG. 11D is an enlarged diagram showing the frame periods shown in FIG. 11C and FIGS. 11E to 11G are drawn on the same time scale as FIG. 11D.

The polarity inversion controller 20 is used to invert the polarity for all of the pixel electrodes which lie on one scanning line (line) when an image of one frame is rewritten, and it basically includes a line counter 49 for counting the number of scanning lines in the image plane, a frame counter 50 for counting the number of times of rewriting the image plane and an inversion discriminator 52 having a comparator 51, and controls the polarity inversion of the display signal according to the timing signal 22 supplied from the display timing controller 23. The line counter 49 is cleared (reset) by a negative synchronizing signal 53 shown in FIG. 11C each time the image plane is rewritten and counts the number of lines 54 for each image plane as shown in FIGS. 11E and 11F. The frame counter 50 counts the number of image plane rewriting times 55 as shown in FIG. 11F, but is not reset, and when the counting operation for one image plane 56 (L in FIG. 11B) is completed, it starts the counting operation from "1". The comparator 51 is supplied with two values, that is, a value supplied from the frame counter 49 and updated at each time of rewriting of the image plane and a value supplied from the line counter 50 and updated for each scanning line, and outputs a coincidence output 57 to an exclusive-OR circuit 59 as shown in FIG. 11G when the values from the frame counter 49 and line counter 50 coincide with each other at a certain value n. A signal 38 shown in FIG. 11A is a vertical synchronizing signal among the synchronizing signal supplied to the display timing controller 23 shown in FIG. 4.

The exclusive-OR circuit 59 is supplied with the coincidence output 57 and an output of a memory 60 which holds the polarity inversion signal and inverts the output of the memory 60 only when the coincidence output 57 is present. That is, when the output of the frame counter 50 is n, the polarity only for the n-th line is inverted. The polarity inversion signal, that is, an updated output of the exclusive-OR circuit 59 is supplied to the display timing controller 23 shown in FIG. 4 via a switching circuit 61 and latch circuit 62. Further, the output of the exclusive-OR circuit 59 is fed back to the memory 60 via the switching circuit 61 and held therein until the next updating operation. The address of the memory 60 is controlled by a memory address counter 63. The address of the memory address counter 63 is set equal to the address of the line counter 49.

Thus, the polarity inversion signal created in the polarity inversion controller 20 is output to the display timing controller 23 shown in FIG. 4 and the display timing controller 23 controls the display operation and the polarity inversion of the display signal based on the polarity inversion signal.

Figure 12:
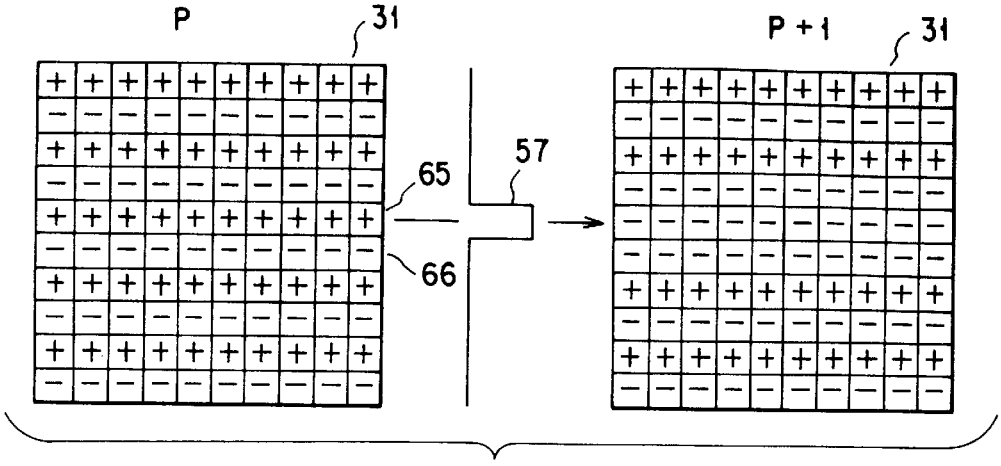
FIG. 12 is a diagram for illustrating the polarity inversion of the pixel electrode in the third embodiment.

If the liquid crystal display apparatus is driven by the above method, the polarity inversion is effected only for an n-th line 65 at the time of rewriting of the image plane of one frame when the output of the frame counter is n and the polarity inversion is effected only for an (n+1)th line 66 when the output of the frame counter is set to a next value (n+1) as indicated by a P-th frame and (P+1)th frame in FIG. 12. When the number of scanning lines on the image plane of one frame is L, the polarity inversion for the entire portion of the image plane is completed by rewriting the image planes of L frames.

Therefore, if the liquid crystal display device is driven by the above driving circuit, a lowering in the contrast caused when the polarity of the display signal is inverted, that is, a variation in the transmittance caused by placing the liquid crystal display device in the electric field "0" is limited to part of the image plane, and it becomes possible to prevent deterioration in the contrast in the entire portion of the image plane and an image with high image quality and high contrast can be displayed.

The liquid crystal display device of this embodiment is a 15-inch XGA, the pixel size is 300 $\mu$m in length×100 $\mu$m width and it is driven in the horizontal line inversion driving mode (voltages of opposite polarities are applied to pixels connected to the adjacent gate lines). When an attention is given to a region of 3 mm×3 mm on the image plane, 10 scanning lines (gate lines) and 300 pixels are present in the region. When the polarity inversion is effected for one scanning line in a certain frame, the number of pixels to which a positive voltage is applied becomes equal to the number of pixels to which a negative voltage is applied. When the polarity inversion is effected as shown in FIG. 12, the number of pixels of positive polarity is 120 and the number of pixels of negative polarity is 180 in the region of 3 mm×3 mm. When the number of pixels of positive polarity is divided by the number of pixels of negative polarity, 0.667 is obtained. Such a difference between the numbers of pixels of positive and negative polarities was not visually observed when viewing the liquid crystal display device in the oblique direction within an angle of 70 degrees.

Figure 13:
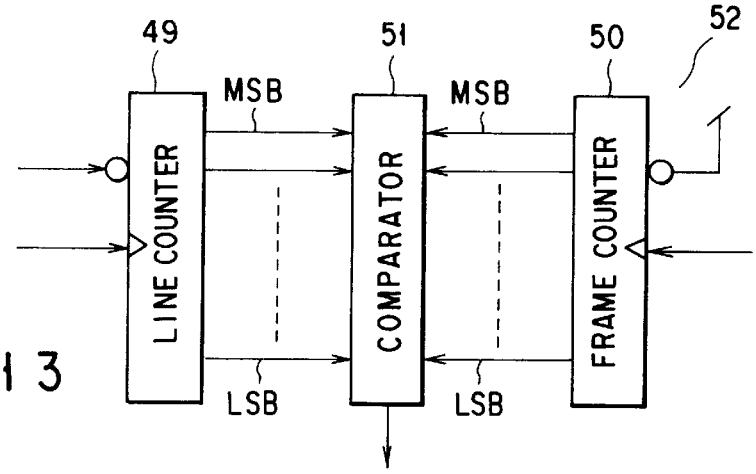
FIG. 13 is a block diagram showing the construction of a polarity inversion determining circuit of the polarity inversion controller in the third embodiment.
Figure 14:
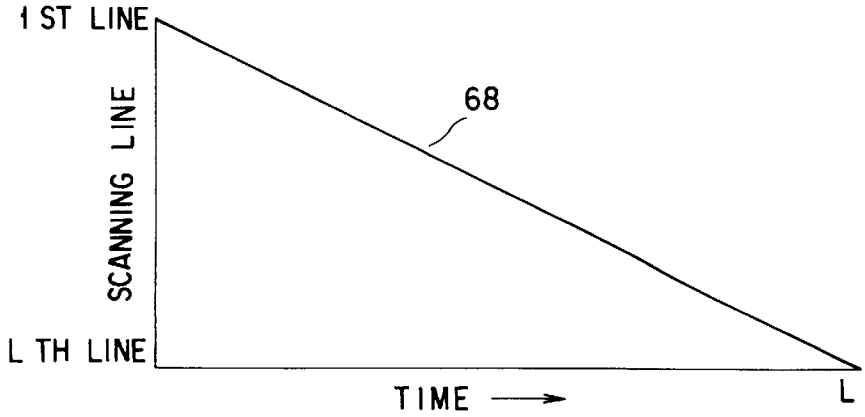
FIG. 14 is a diagram for illustrating the order of polarity inversion determined by the polarity inversion determining circuit.

The order of the polarity inverting operations is determined by the constructions of the line counter 49, frame counter 50 and comparator 51 of the polarity inversion controller 20. For example, as shown in FIG. 13, if the output of the line counter 49 and the output of the frame counter 50 have the same array from the most significant bit MSB to the least significant bit LSB, a coincidence output from the comparator 51 is output in an order from the first line to the L-th line and the polarity inversion is effected in a preset order. Therefore, the position in which the polarity inversion is effected on the image plane is set as indicated by a solid line 68 in FIG. 14 and there may occur a possibility that harmful effects of polarity inversion caused by the movement of the polarity inversion position from the upper position to the lower position will be visually observed.

Figure 15:
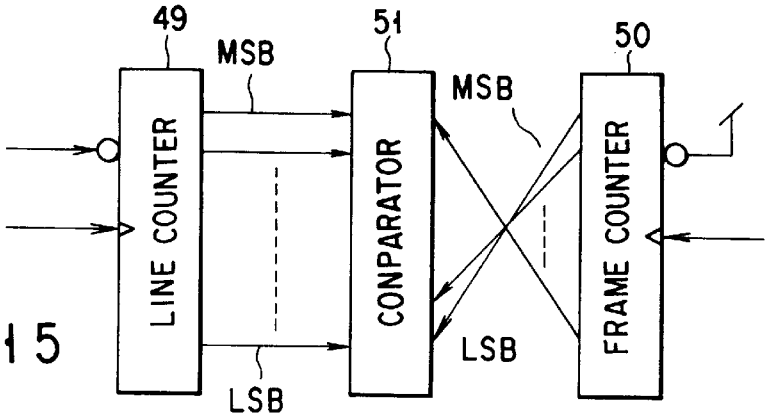
FIG. 15 is a block diagram showing another construction of the polarity inversion determining circuit of the polarity inversion controller in the third embodiment.
Figure 16:
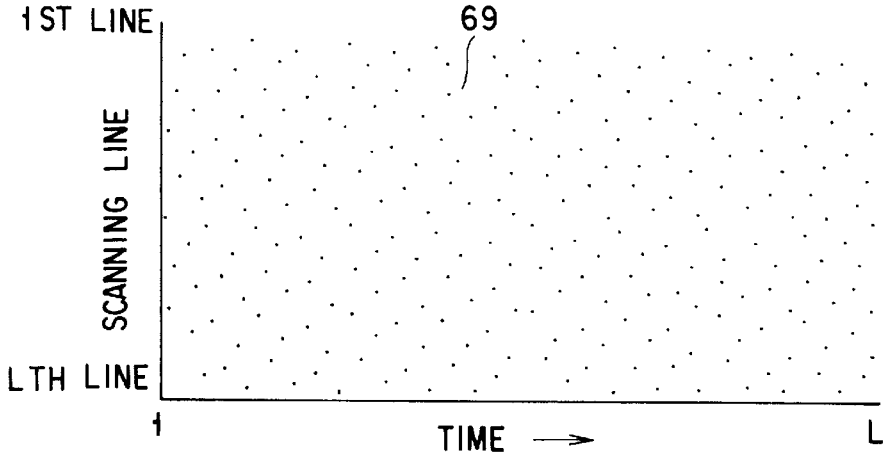
FIG. 16 is a diagram for illustrating the order of polarity inversion determined by the polarity inversion determining circuit.

Therefore, in order to make it difficult to visually recognize the polarity inversion position, it is desirable to randomly effect the polarity inversion for the adjacent frames, preferably, for each line so as to prevent the regularity of polarity inversion from being recognized rather than sequentially change the polarity inversion position. In FIG. 15, a case wherein a wiring for the output of the line counter 49 and the output of the frame counter 50 is changed to replace the position of most significant bit MSB with the position of least significant bit LSB is shown as one example. With this change of wiring, the polarity can be apparently randomly inverted as indicated by a point 69 in FIG. 16.

When the polarity inversion is effected by the above method, the polarity inversion for all of the lines is completed in a period of L frames if the image plane of one frame is constructed by L lines. However, in this case, since the polarity inversion is effected for each line, the display signal of a positive polarity or negative polarity is applied to all of the pixel electrodes on the image plane at a certain time. If the display signal of a positive polarity or negative polarity is thus applied to all of the pixel electrodes, there occurs a possibility that deterioration in the image quality such as flickers may occur due to a difference between the positive polarity and the negative polarity. Therefore, it is preferable that the display region of positive polarity and the display region of negative polarity are present in substantially the same ratio in the image plane of one frame before and after the polarity inversion.

Figure 17:
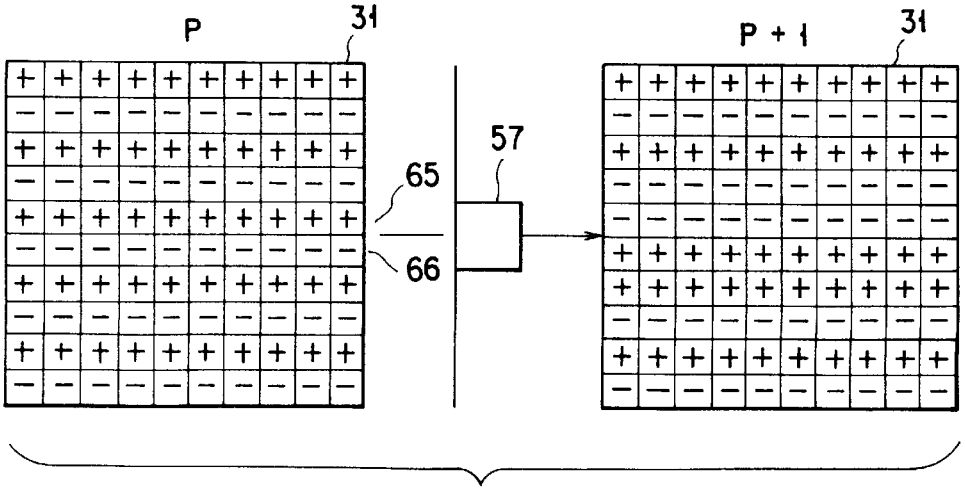
FIG. 17 is a diagram for illustrating different polarity inversion of the pixel electrode in the third embodiment.

In order to attain the above purpose, an initial pattern generator 71 is provided in the polarity inversion controller 20 shown in FIG. 10, a polarity pattern in which the positive polarity and the negative polarity are present in the same ratio is previously input to the initial pattern generator 71, and the polarity pattern in which the positive polarity and the negative polarity are present in the same ratio may be input to the memory 60 when the power source switch is turned ON or a reset signal is supplied. For example, if a pattern in which even lines are set to the positive polarity and odd lines are set to the negative polarity is set as an initial value in the initial pattern generator 71, a display signal of the positive polarity and a display signal of the negative polarity are supplied in the same ratio to the image plane of one frame. If the polarity of the display signal is set as described above, the ratio of the positive polarity and the negative polarity can be kept unchanged before and after the polarity inversion by simultaneously effecting the polarity inversion for the adjacent two lines. That is, in a case of inverting the polarities for an n-th line 65 and an (n+1)th line 66 as shown in FIG. 17, the ratio of the positive polarity and the negative polarity present in the P-th frame before the polarity is kept unchanged even in the (P+1)th frame although the array of polarities is changed.

The operation of simultaneously effecting the polarity inversion for the two lines at the time of rewriting of the image plane of one frame can be easily attained by reducing the number of bits of the line counter 41 and the frame counter 42 by one bit in comparison with a case wherein the polarity inversion is effected for each line.

(Fourth Embodiment)

In the third embodiment, a case wherein the polarity inversion is effected for each line is explained, but the same construction except the polarity inversion controller can be used when the polarity inversion is effected for each pixel electrode.

Figure 18:
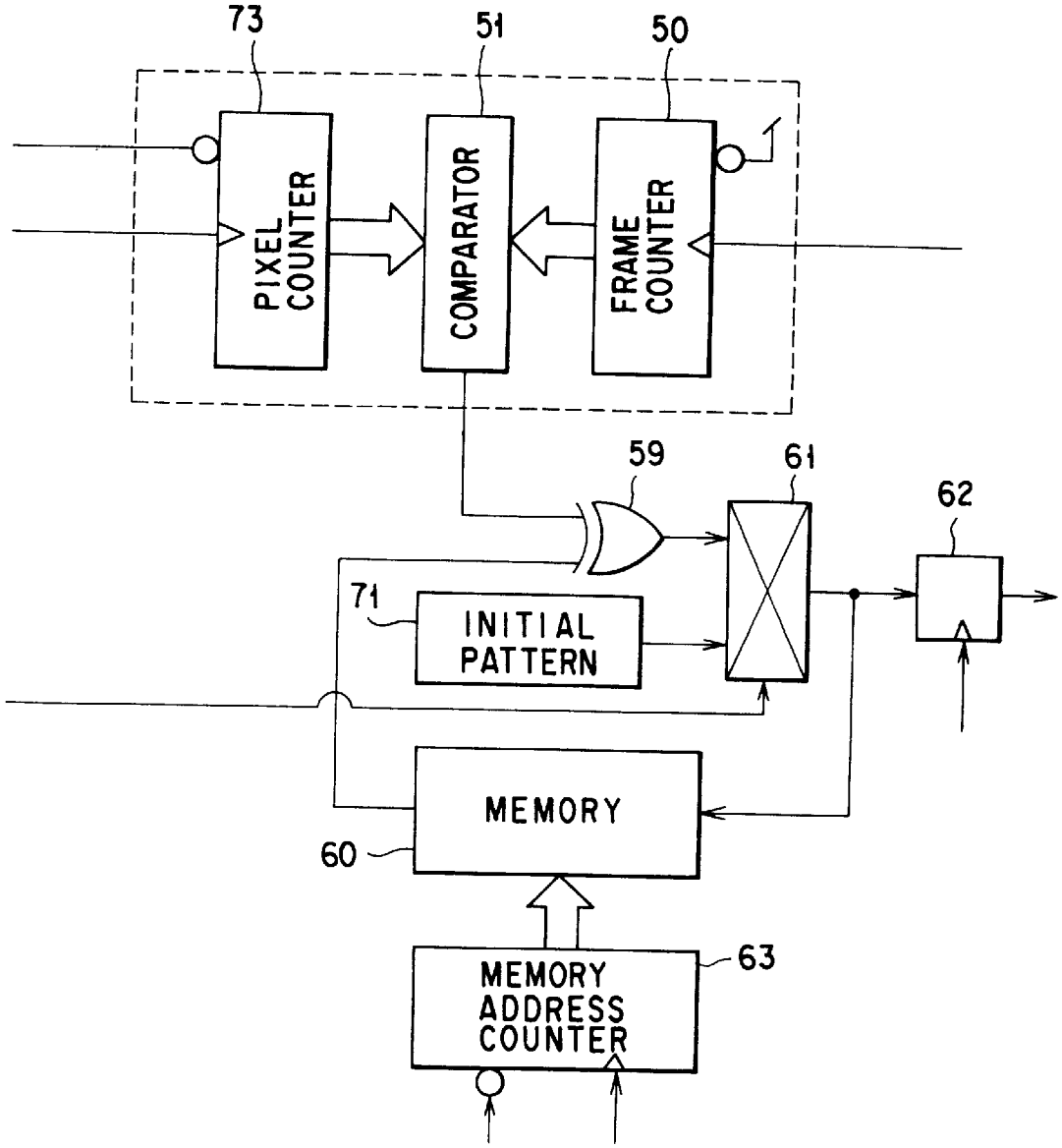
FIG. 18 is a block diagram showing the construction of a polarity inversion controller for controlling the polarity inversion of the pixel electrode in a fourth embodiment of this invention.

The polarity inversion controller used when the polarity inversion is effected for each pixel electrode is shown in FIG. 18. The polarity inversion controller 20 is basically obtained by replacing the line counter of the polarity inversion controller shown in FIG. 10 by a pixel counter 73. Further, the number of bits of the frame counter 50, comparator 51 and memory 60 is expanded to the number of bits corresponding to the number of pixels present in the image plane of one frame and the polarity inversion is effected for each pixel. In the other respect, the polarity inversion can be effected by the same operation as that effected when the polarity inversion is effected for each line.

In this case, a polarity pattern in which the positive polarity and the negative polarity are present in the same ratio, for example, a pattern in which even-numbered pixels are set to the positive polarity and odd-numbered pixels are set to the negative polarity is previously input to the initial pattern generator 71 and the polarity inversion can be simultaneously effected for an even number of pixel electrodes. As a result, the polarity inverting operation can be effected in a state in which the display signals having different polarities for different pixel electrodes are present in the same ratio in the image plane of one frame.

Further, the order of polarity inverting operations for each pixel, that is, the position of a pixel which is to be subjected to the polarity inversion in the adjacent frames can be determined by replacing the output bits of the pixel counter 72 and the frame counter 40 which are input to the comparator 51 with each other in the same manner as in a case wherein the polarity inversion is effected for each line and thus the polarity inversion can be effected in a desired order.

By effecting the polarity inversion for each pixel as described above, the polarity inversion is effected in a smaller region than in a case wherein the polarity inversion is effected for each line so that a lowering in the contrast caused when the polarity of the display signal is inverted can be prevented and an image with high contrast and high image quality can be displayed.

(Fifth Embodiment)

In a liquid crystal display apparatus in which liquid crystal having spontaneous polarization is disposed between the pixel electrodes and the common electrode, an image sticking phenomenon that a preceding image remains will not easily occur even if the period of the polarity inversion of the display signal is made longer. However, if a still image is displayed for a long period of time, the image sticking phenomenon that the image remains occurs.

Charges stored on the surface of the alignment film can be dispersed or eliminated by making conductive the surface portions of the alignment films 32*a* and 32*b* of the liquid crystal display device 24 shown in FIGS. 5A and 5B, and as a result, the image sticking phenomenon of the liquid crystal display apparatus can be prevented.

In a liquid crystal display apparatus in which liquid crystal having spontaneous polarization is disposed between the pixel electrodes and the common electrode and the surface portions of the alignment films 32*a* and 32*b* are made conductive, it is possible to freely invert the polarity of the display signal for every preset frame period.

In order to make conductive the surface portions of the alignment films 32*a* and 32*b* of the liquid crystal display device 24, for example, a conductive material may be dissolved into the surface portion of the alignment films 32*a* and 32*b* formed of polyimide resin.

The conductive material is not specifically limited, but it is preferable to use organic charge-transfer complex obtained by reacting an electron donor and an electron acceptor in the mole ratio of 1:1 as the conductive material. As the electron donor, the following materials are given:

bis(ethylenedithio)tetrathiafulvalene,
bis(methylenedithio)tetrathiafulvalene,
bis(trimethylenedithio)tetrathiafulvalene,
4,4'-dimethyltetrathiafulvalene,
tetrakis(octadecylthio)tetrathiafulvalene,
tetrakis(n-pentylthio)tetrathiafulvalene,
tetrakis(alkylthio)tetrathiafulvalene,
tetrathiafulvalene, and
tris(tetrathiafulvalene)bis(tetrafluoroborate).

Further, as the electron acceptor, for example, the following materials are given:

bis(tetra-n-butylammonium) tetracyanophenoquinometanide,
2,5-dimethyl-7,7,8,8-tetracyanoquinodimethane,
11,11,12,12-tetracyanonapth-2,6-quinodimethane,
7,7,8,8-tetracyanoquinodimethane, and
tetracyanoquinodimethane.

The organic charge-transfer complex formed of an electron donor and an electron acceptor is dissolved into polyimide resin by 0.001 to 20 weight %, preferably 0.1 to 2 weight %. If the weight % is less than 0.001 weight %, a sufficiently large effect of preventing the image sticking phenomenon cannot be attained. Further, if the weight % is larger than 20 weight %, some organic charge-transfer complex cannot be dissolved and remains and the polyimide film cannot be used as the alignment film.

Next, a concrete example of the fifth embodiment is explained.

In the liquid crystal display device 24 shown in FIGS. 5A and 5B, alignment films 32*a* and 32*b* were formed by dissolving organic charge-transfer complex containing tetrakis(n-pentylthio)tetrathiafulvalene as the electron donor and 7,7,8,8-tetracyanoquinodimethane as the electron acceptor by one weight % into the surface portion of a fusible polyimide film, for example, a thin film formed of AL-1031 made by Japan Synthetic Rubber Co., Ltd. on a first substrate 28 having TFTs and pixel electrodes 31 arranged in a matrix form and a second substrate 29 having a color filter 33 and a common electrode 34 formed thereon, and then antiferroelectric liquid crystal formed of MCL-0049 made by MITSUI PETROCHEMICAL INDUSTRIES, LTD. was sealed between the pixel electrodes 31 and the common electrode 34 with the alignment films 32*a* and 32*b* disposed therebetween to form a liquid crystal display device with the height 80 mm and the width 107 mm and the cell gap 2 μm.

The polarity inversion of voltages applied between the pixel electrodes and the common electrode was effected for every 150 minutes. As the result that an NTSC TV video image was displayed, a high contrast of 100:1 was obtained. After a still picture was displayed for 120 minutes, the picture was changed to a moving picture, but the still picture was not superposed on the moving picture and was not observed. That is, the image sticking phenomenon did not occur.

Further, with a liquid crystal display device having the same structure and formed without dissolving organic charge-transfer complex into the surface portion of the alignment film, the polarity inversion of voltages applied between the pixel electrodes and the common electrode was effected for every 150 minutes. As the result that an NTSC TV video image was displayed, a high contrast of 100:1 was obtained. However, in this liquid crystal display device, when a still picture was displayed for 120 minutes and then the picture was changed to a moving picture, the still picture was observed in superposition on the moving picture. That is, the image sticking phenomenon occurred and the display quality was lowered.

This embodiment has a feature that the surface of the alignment film is made conductive, but preferably, the resistivity of the surface portion of the alignment film is set to $10^7$ to $10^9$ Ωcm.

(Sixth Embodiment)

This embodiment is similar to the first embodiment except the structure of the liquid crystal display device and that the polarity inversion period is set to 6.4 sec., the display device is driven in the signal line inversion driving mode, and the polarity inversion is effected by dealing with a plurality of pixels connected to one scanning line (gate line) as one unit.

First, a first substrate having TFT elements and pixel electrodes arranged in a matrix form and a second substrate having a color filter and a black matrix formed thereon are prepared.

The structure of the TFT element is explained with reference to FIGS. 5B and 5C below. Gate lines 37 formed on the first substrate are covered with a gate insulating film having a laminated structure of a gate oxide film and a silicon oxide film and a semiconductor thin film formed of a polysilicon thin film is formed on the gate insulating film. A channel protection film formed of a silicon nitride film for protecting the semiconductor thin film at the time of channel formation is formed on the semiconductor thin film. Source electrodes electrically connected to the semiconductor thin film via an ohmic contact layer and drain electrodes integrally formed with the signal line are formed on the semiconductor thin film and channel protection film. Further, a planarization film with a thickness of 4 μm formed of photosensitive resin of benzocyclobutene polymer is formed on the structure. Pixel electrodes are formed on the planarization film, and since through holes are formed in the planarization film, the source electrodes and the common electrode are connected via the through holes. By thus covering the signal lines 36 with the planarization film, occurrence of defects due to the short circuit with the common electrode on the second substrate can be suppressed.

Next, the structure of the second substrate is explained. On the inner surface of the second substrate, a black matrix of chrome is formed. Photosensitive resin having red pigments dispersed therein is formed on the black matrix by the PEP process to form a red color filter. Likewise, green and blue color filters are formed. At this time, photosensitive resin having red pigments dispersed therein, photosensitive resin having green pigments dispersed therein and photosensitive resin having blue pigments dispersed therein are formed in an overlapped form on part of the black matrix which faces the gate line to form a column-form projection with the length 7 μm, width 4 μm and height 2 μm. The projection functions as a spacer for keeping the distance between the first and second substrates constant when the cell is formed. Then, a common electrode formed of a transparent conductive film of ITO is formed on the resultant structure. Further, an insulating film formed of silicon oxide is formed on the entire portion of the pixel region on the transparent conductive film to a thickness of 100 nm. Thus, the pixels, signal lines and TFTs on the first substrate and the common electrode can be prevented from being short-circuited to each other via dusts or the like.

A thin film of thermosetting polyimide (SE-150 made by NISSAN CHEMICAL INDUSTRIES, LTD.) is offset-printed as an alignment film on the first substrate having the TFT elements formed thereon and the second substrate having the color filter and black matrix formed thereon, the polyimide film is cured at 90° C. for 30 minutes by use of a hot plate and then further cured at 220° C. for 60 minutes in a nitrogen oven. The thus formed polyimide alignment film (film thickness 60 nm) is subjected to the rubbing process. The rubbing directions are set in parallel to each other on the first and second substrates and the cross rubbing angle is set to 5 degrees.

Next, a sealing material formed of thermosetting epoxy resin is printed on the peripheral portion of the second substrate to form one injection port on each of the opposite sides thereof. The first and second substrates are placed to face each other and combined together and are heated at 160° C. for three hours to set or cure the sealing material while they are pressed to each other so as to form a cell. A tube is connected to one of the injection ports to lower the pressure and thresholdless antiferroelectric liquid crystal composition (MLC series made by MITSUI PETRO- CHEMICAL INDUSTRIES, LTD., a phase series:solid phase→−30° C.'→smectic C phase→75° C.→smectic A phase→80° C.→isotropic phase; response time=300 μs) is introduced by suction via the other injection port while it is heated at 100° C. After this, the injection ports are sealed with epoxy-series resin. The cell gap is set to 2.0 μm.

A polarizing plate is attached to the first substrate while the transmission axis of the polarizing plate is set in substantially parallel (approximately 2.5 degrees) to the rubbing direction outside the second substrate. A sheet-form heater is attached to the polarizing plate. The sheet-form heater has a structure obtained by forming a transparent conductive film of ITO on a polycarbonate substrate and is used to heat liquid crystal to keep the good display quality even in an application environment of 0° C. or lower. When a force is applied to the liquid crystal display device by pressing the same by a finger, for example, the sheet-form heater functions as a buffer member for weakening the applied force. Thus, a liquid crystal display device of 15-inch width in the diagonal direction is completed.

After this, the liquid crystal display device is gradually cooled from 90° C. to the room temperature for 30 minutes (voltage application alignment process) while a DC voltage 25V is applied to the gate line to keep the gate in the ON state, a triangular wave (1 Hz) of 20V is applied to the signal line and 0V is applied to the common electrode. By this operation, the orientation of the liquid crystal is made uniform. A driving circuit is mounted on the liquid crystal display device. Further, a back light is placed outside the first substrate and put into a casing to complete a liquid crystal display apparatus.

Figure 19A:
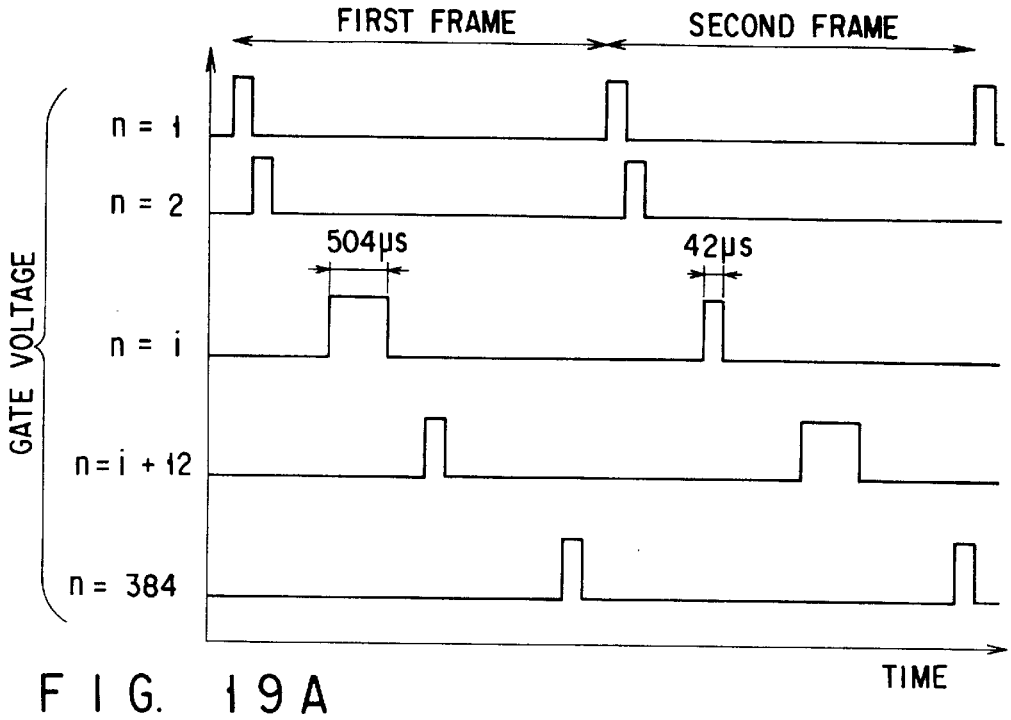
FIGS. 19A and 19B are waveform diagrams drawn on the same time scale, for illustrating a method for driving the liquid crystal display apparatus according to a fifth embodiment of this invention, FIG. 9A showing the gate voltage of a scanning line and FIG. 9B showing a write-in voltage applied to the pixel electrode.
Figure 19B:
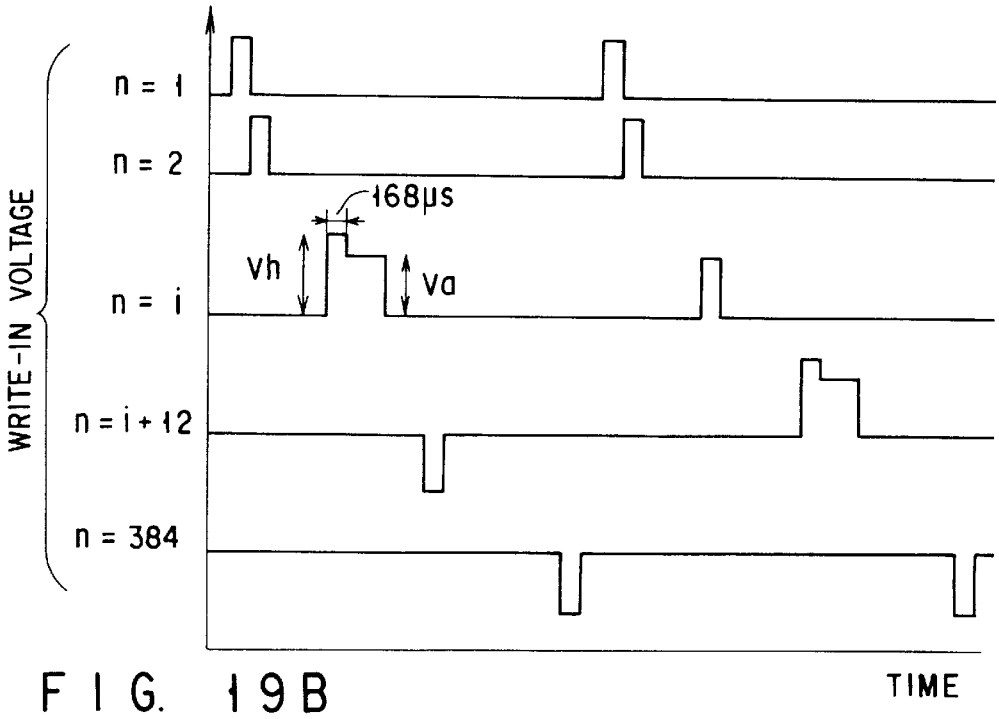

The driving method is explained below. In FIGS. 19A and 19B, gate signals for pixels connected to one line and voltages (write-in voltages) applied between the pixel electrodes and the common electrode are shown. Since the definition of the liquid crystal display apparatus of this embodiment is set at the XGA level, the number of gate lines is set to 768. However, since the pixels of the liquid crystal display apparatus are divided into upper and lower two groups and driven, the number of gate lines scanned in one frame period (16.67 ms) becomes 384. In this embodiment, since the gate-ON period is set to 42 μs, the blanking time is set to 16.67 ms−42 μs×384=0.54 ms. By use of the blanking time, the gate-ON period (write-in time) is extended to 504 μs at the time of polarity inversion.

In FIG. 19A, the polarity inversion from negative to positive is effected for a pixel connected to the i-th gate line in the first frame. Since the signal line inversion driving operation is effected, the polarity inversion from positive to negative is effected for a pixel adjacent to the i-th pixel shown in FIG. 19A in the first frame. The polarity inversion is effected at a rate of one gate line for each frame. Therefore, time required for terminating the inverting operation for all of the pixels, that is, the period of polarity inversion of a certain pixel becomes 16.67 ms×384=6.4 sec.

In the write-in operation at the time of polarity inversion, Vh is applied in the first period of 168 μs and a voltage Va corresponding to the display signal is applied in the latter period of 336 μs. In other words, as the signal voltage of a signal line (not shown), Vh is applied in the first 168 μs period and a voltage Va corresponding to the display signal is applied in the remaining period of the frame periods of the succeeding two or more frames. By setting the absolute value of Vh larger than the absolute value of Va, a lowering in the light intensity at the time of polarity inversion can be prevented. Where Vh was set to ±7V, the maximum and minimum values of Va were set to ±5V, and the display signal was kept unchanged in the first and second frames, the light intensity in the first frame and the light intensity in the second frame became equal to each other and a variation in the light intensity at the time of polarity inversion was not observed at all.

The order of polarity inverting operations is set such that n=1, 13, 25, . . . , 373, 2, 14, . . . , 384. That is, if the polarity inversion for the i-th pixel is effected in the first frame, the polarity inversion for the (i+12)th pixel is effected in the second frame. Thus, as the gate lines to be subjected to the polarity inversion in a certain frame and a next frame are separated farther away from each other, a variation in the light intensity at the time of polarity inversion becomes more difficult to be visually observed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for driving a liquid crystal display apparatus which includes liquid crystal having spontaneous polarization disposed between a plurality of pixel electrodes arranged in a matrix form and a common electrode disposed to face the pixel electrodes, the liquid crystal having a dark state when no voltage is applied to the liquid crystal and a bright state when a positive or a negative voltage is applied to the liquid crystal, comprising:

a polarity inversion step of periodically inverting polarities of at least one part of voltages applied between the plurality of pixel electrodes and the common electrode; and a write-in step of applying voltages to the pixel electrodes to hold display voltages corresponding to the applied voltages to the pixel electrodes, respectively;

wherein the polarity of inversion step includes a step of effecting the polarity inversion to satisfy an expression of $TS/TF \geqq 2$ when a frame period is set to TF and a period for effecting the polarity inversion is set to TS.

2. A method for driving a liquid crystal display apparatus according to claim 1, wherein the polarity inversion step is effected to satisfy an expression of $TS/TF \geqq \tau/TK \geqq 2$ when a response time of the liquid crystal is set to $\tau$ and a write-in time is set to TK.

3. A method for driving a liquid crystal display apparatus according to claim 1, wherein the write-in step includes a step of setting the write-in time for the pixel electrodes subjected to the polarity inversion among the plurality of pixel electrodes longer than the write-in time for the pixel electrodes other than the pixel electrodes subjected to the polarity inversion.

4. A method for driving a liquid crystal display apparatus according to claim 1, wherein the write-in step includes a step of setting the write-in voltage for each of the pixel electrodes subjected to the polarity inversion among the plurality of pixel electrodes higher than the write-in voltage for each of the pixel electrodes other than the pixel electrodes subjected to the polarity inversion.

5. A method for driving a liquid crystal display apparatus according to claim 1, wherein the polarity inversion step includes a step of inverting the polarities of the voltages applied to the at least one part of the pixel electrodes in an image plane and includes a plurality of sub-steps of completing the polarity inversion for an entire portion of the image plane while sequentially changing the at least one part of the pixel electrodes to be subjected to the polarity inversion.

6. A method for driving a liquid crystal display apparatus according to claim 5, wherein the polarity inversion step includes a step of effecting the polarity inversion in an image plane for at least one of the plurality of pixel electrodes.

7. A method for driving a liquid crystal display apparatus according to claim 5, wherein the polarity inversion step includes a step of effecting the polarity inversion in an image plane for all of the pixel electrodes which lie on at least one scanning line among the plurality of pixel electrodes.

8. A method for driving a liquid crystal display apparatus according to claim 5, wherein the polarity inversion step includes a step of effecting the polarity inversion in a state in which a ratio of the pixel electrodes to which a positive voltage is applied to the pixel electrodes to which a negative voltage is applied is set within a range of 0.5 to 2 in a desired region of 3 mm×3 mm in an image plane.

9. A method for driving a liquid crystal display apparatus according to claim 1, wherein the step of effecting the polarity inversion to satisfy the expression of $TS/TF \geqq 2$ is effected in a partial region of an image plane while a polarity inversion for each frame is effected in a region other than the partial region.

10. A method for driving a liquid crystal display apparatus according to claim 1, wherein the step of effecting the polarity inversion to satisfy the expression of $TS/TF \geqq 2$ is intermittently effected for periods of time with an elapse of time while a polarity inversion for each frame is effected in other periods of time.

11. A method for driving a liquid crystal display apparatus according to claim 1, further comprising alignment films each formed on the pixel electrodes and the common electrode, a surface portion of the alignment film being made electrically conductive.

12. A liquid crystal display apparatus comprising:

a first substrate;

a plurality of pixel electrodes arranged in a matrix form on the first substrate;

a second substrate disposed to face a surface of the first substrate on which the plurality of pixel electrodes are formed;

a common electrode formed on the second substrate to face the plurality of pixel electrodes; and liquid crystal having spontaneous polarization and held between the first and the second substrate;

wherein the liquid crystal display apparatus has a dark state when no voltage is applied to the liquid crystal, a bright state when a positive or a negative voltage is applied to the liquid crystal, and an operation of periodical polarity inversion for at least one part of voltages applied between the plurality of pixel electrode and the common electrode, and a write-in operation for applying voltages to the pixel electrode to hold display voltages corresponding to the applied voltages to the pixel electrodes, respectively, and the polarity inversion operation is effected to satisfy an expression of $TS/TF \geqq 2$ when a frame period is set to TF and a period for effecting the polarity inversion is set to TS.

13. A liquid crystal display apparatus according to claim 12, wherein the polarity inversion operation is effected to satisfy an expression of $TS/TF \geqq \tau/TK \geqq 2$ when a response time of the liquid crystal is set to $\tau$ and a write-in time is set to TK.

14. A liquid crystal display apparatus according to claim 12, wherein the write-in operation includes an operation for setting the write-in time for the pixel electrodes subjected to the polarity inversion among the plurality of pixel electrodes longer than the write-in time for the pixel electrodes other than the pixel electrodes subjected to the polarity inversion.

15. A liquid crystal display apparatus according to claim 12, wherein the write-in operation includes an operation for setting the write-in voltage for each of the pixel electrodes subjected to the polarity inversion among the plurality of pixel electrodes higher than the write-in voltage for each of the pixel electrodes other than the pixel electrodes subjected to the polarity inversion.

16. A liquid crystal display apparatus according to claim 12, wherein the polarity inversion operation includes an operation for inverting polarities of voltages applied to the at least one part of the pixel electrodes in an image plane and includes a plurality of operations for completing the polarity inversion for an entire portion of the image plane while sequentially changing the at least one part of the pixel electrodes to be subjected to the polarity inversion.

17. A liquid crystal display apparatus according to claim 16, wherein the polarity inversion operation includes an operation for effecting the polarity inversion in an image plane for at least one of the plurality of pixel electrodes.

18. A liquid crystal display apparatus according to claim 16, wherein the polarity inversion operation includes an operation for effecting the polarity inversion in an image plane for all of the pixel electrodes which lie on at least one scanning line among the plurality of pixel electrodes.

19. A liquid crystal display apparatus according to claim 16, wherein the polarity inversion operation includes an operation for effecting the polarity inversion in a state in which a ratio of the pixel electrodes to which a positive voltage is applied to the pixel electrodes to which a negative voltage is applied is set within a range of 0.5 to 2 in a desired region of 3 mm×3 mm in an image plane.

20. A liquid crystal display apparatus according to claim 12, wherein the polarity inversion operation effected to satisfy the expression of $TS/TF \geqq 2$ is effected in a partial region of an image plane and a polarity inversion for each frame is effected in a region other than the partial region.

21. A liquid crystal display apparatus according to claim 12, wherein the polarity inversion operation effected to satisfy the expression of $TS/TF \geqq 2$ is intermittently effected for periods of time with an elapse of time while a polarity inversion for each frame is effected in other periods of time.

22. A liquid crystal display apparatus according to claim 12, further comprising alignment films each formed on the pixel electrodes and the common electrode, a surface portion of the alignment film being made electrically conductive.

* * * * *